US008606143B2

(12) United States Patent
Kikuchi

(10) Patent No.: US 8,606,143 B2
(45) Date of Patent: Dec. 10, 2013

(54) ELECTROPHOTOGRAPHIC IMAGE FORMING APPARATUS WITH CONTACTING AND SPACING MEMBER

(75) Inventor: Ken Kikuchi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 105 days.

(21) Appl. No.: 13/050,209

(22) Filed: Mar. 17, 2011

(65) Prior Publication Data

US 2011/0164897 A1 Jul. 7, 2011

Related U.S. Application Data

(63) Continuation of application No. PCT/JP2009/067310, filed on Sep. 29, 2009.

(30) Foreign Application Priority Data

Sep. 29, 2008 (JP) ..... 2008-250333
Feb. 9, 2009 (JP) ..... 2009-027689

(51) Int. Cl.
*G03G 21/16* (2006.01)

(52) U.S. Cl.
USPC ..... 399/111; 399/112

(58) Field of Classification Search
USPC ..... 399/111, 112, 113, 299
See application file for complete search history.

(56) References Cited

U.S. PATENT DOCUMENTS 6,453,135 B1 9/2002 Sameshima et al.
6,708,011 B2 3/2004 Nomura et al.
6,735,405 B2 5/2004 Yokoi et al.
6,832,057 B2 12/2004 Oguma et al.
6,944,415 B2 * 9/2005 Nomura ..... 399/111
6,952,544 B2 10/2005 Kikuchi et al.
7,058,337 B2 6/2006 Hashimoto et al.
7,073,251 B2 7/2006 Kikuchi et al.
7,079,787 B2 7/2006 Ogino et al.

(Continued)

FOREIGN PATENT DOCUMENTS

CN 1637661 7/2005
JP 2001-142378 5/2001

(Continued)

OTHER PUBLICATIONS

International Search Report and Written Opinion for PCT/JP2009/067310.

(Continued)

*Primary Examiner* — Robert Beatty
(74) *Attorney, Agent, or Firm* — Fitzpatrick, Cella, Harper & Scinto

(57) ABSTRACT

A downsized electrophotographic image forming apparatus with which a drawer member mounting a photosensitive drum and a developing unit is mounted into a main assembly of the apparatus, and the developing roller and the photosensitive drum can be contacted and spaced relative to each other is provided. It includes a process cartridge, a main assembly of the apparatus, and a drawer member 13 movable between an inside position which is inside the main assembly of the apparatus and which the drawer member 13 supports the process cartridge and an outside position which is outside the main assembly of the apparatus. The drawer member 13 further includes a contacting and spacing member 42 capable of taking a contacting position for contacting the developing roller to the photosensitive drum and a spacing position for spacing the developing roller from the photosensitive drum.

6 Claims, 35 Drawing Sheets

(56) References Cited

U.S. PATENT DOCUMENTS

| | | | | |
|---|---|---|---|---|
| 7,200,350 | B2 | 4/2007 | Agata et al. | |
| 7,296,341 | B2 | 11/2007 | Kikuchi et al. | |
| 7,509,071 | B2 * | 3/2009 | Yoshimura et al. | 399/111 |
| 7,567,769 | B2 * | 7/2009 | Noguchi et al. | 399/110 |
| 7,715,756 | B2 * | 5/2010 | Hattori | 399/119 |
| 7,817,936 | B2 | 10/2010 | Kikuchi et al. | |
| 7,860,433 | B2 * | 12/2010 | Toba et al. | 399/111 |
| 8,116,652 | B2 | 2/2012 | Okabe | |
| 8,126,358 | B2 * | 2/2012 | Tomatsu | 399/113 |
| 8,213,830 | B2 | 7/2012 | Nakashima | |
| 8,290,395 | B2 * | 10/2012 | Uchida | 399/110 |
| 2007/0160386 | A1 | 7/2007 | Kawamura | |
| 2007/0160388 | A1 | 7/2007 | Yoshimura et al. | |
| 2007/0280730 | A1 | 12/2007 | Okabe et al. | |
| 2008/0159772 | A1 * | 7/2008 | Koishi et al. | 399/90 |
| 2010/0080615 | A1 | 4/2010 | Kikuchi | |
| 2010/0135691 | A1 | 6/2010 | Kikuchi | |
| 2011/0033201 | A1 | 2/2011 | Akutsu et al. | |
| 2011/0142490 | A1 | 6/2011 | Kikuchi et al. | |
| 2011/0158681 | A1 | 6/2011 | Kikuchi et al. | |

FOREIGN PATENT DOCUMENTS

| | | |
|---|---|---|
| JP | 2003-015378 | 1/2003 |
| JP | 2004-258440 | 9/2004 |
| JP | 2005338775 | 12/2005 |
| JP | 2006-171397 | 6/2006 |
| JP | 2007-213024 | 8/2007 |
| JP | 2007-213025 | 8/2007 |
| JP | 2007-322544 | 12/2007 |
| JP | 2008-026486 | 2/2008 |
| JP | 2009-162903 | 7/2009 |
| JP | 2010-151952 | 7/2010 |
| JP | 2012-137798 | 7/2012 |

OTHER PUBLICATIONS

Office Action in Chinese Patent Application No. 200980138050.3, mailed Aug. 2, 2012 (with excerpt English translation).
Office Action in Japanese Patent Application No. 2011-286696. (with English translation).
Office Action in Japanese Patent Application No. 2012-163698 (with English translation).

* cited by examiner (a)

(b)

ELECTROPHOTOGRAPHIC IMAGE FORMING APPARATUS WITH CONTACTING AND SPACING MEMBER

TECHNICAL FIELD

The present invention relates to an electrophotographic image forming apparatus.

BACKGROUND ART

Heretofore, in the field of an image forming apparatus which uses an electrophotographic image forming process, the process cartridge which includes a photosensitive drum s and a developing roller which acts on the photosensitive drum and a developing unit which contains a developer (toner) to be used for the image formation as a unit is known. A developing cartridge type using the developing unit which does not include the photosensitive drum is also known. According to these cartridge types, a maintenance operation of a device can be carried out by the user without a service person, in effect. For this reason, these cartridge types are widely used for the electrophotographic image forming apparatus.

It is also known that a drawer for carrying the process cartridge or the developing cartridge is provided, and the exchange of the cartridge is capable by drawing this drawer from the inside of the main assembly to a predetermined position. According to this technique, the user can supply the developer easily, in effect.

Here, when the image formation is carried out by the image forming apparatus, the developing roller in the developing unit is in the state of being urged toward the photosensitive drum at a predetermined pressure. In a contact-type developing system in which the developing roller is contacted to the photosensitive drum during the developing operation, an elastic layer of the developing roller is in contact to a surface of the photosensitive drum at the predetermined pressure.

Therefore, when the developing unit is used for a long term in the state that it is mounted to the main assembly of the apparatus, the elastic layer of the developing roller may be deformed. This will result in occurrence of non-uniformity in the image by the developing operation. In addition, since the developing roller is in contact with the photosensitive drum, the developer is deposited on the photosensitive drum from the developing roller unnecessarily. Furthermore, since the photosensitive drum and the developing roller are contacted with each other and rotated even when the developing operation is not carried out, and therefore, the deterioration of the developer and the developing roller is accelerated as the case may be.

In order to suppress the acceleration of the deterioration, Japanese Laid-open Patent Application 2007-213024) discloses a mechanism by which the developing roller is spaced from the photosensitive drum when the image formation is not carried out.

In such a prior-art, a member (movable member) movable between a position for contacting the developing roller to the photosensitive drum and a position for spacing them is provided in a main assembly side of the apparatus. When a drawer member (tray) carrying the cartridge photosensitive drum and the developing roller enters the main assembly of the apparatus, the movable member is in the position away from a movement path of the drawer member. By a door being closed after the drawer member is inserted to a predetermined position in the main assembly of the apparatus, the movable member moves toward the cartridge carried on the drawer member to space the developing roller from the photosensitive drum.

However, in such conventional example, the movable member is provided in the main assembly side of the apparatus. Therefore, when the drawer member is moved into the main assembly of the apparatus, it is required that the movable member is retracted to the position not interfering with the drawer member. In addition, in order to space the developing roller from the photosensitive drum, it is necessary to move the movable member to the position of the cartridge on the drawer member. For this reason, the space is required in the main assembly of the apparatus in order to permit the movement of the movable member from the main assembly side of the apparatus to the cartridge position in the drawer member. This impedes downsizing of the main assembly of the apparatus.

DISCLOSURE OF THE INVENTION

It is a principal object of the present invention to provide a downsized electrophotographic image forming apparatus in which a drawer member carrying a photosensitive drum and a developing unit is inserted into the main assembly of the apparatus, and in which the developing roller and the photosensitive drum can be contacted and spaced relative to each other.

The present invention employs the following means to solve the problem.

According to an aspect of the present invention, there is provided a An electrophotographic image forming apparatus comprising: a process cartridge including an electrophotographic photosensitive member, a developing roller for developing an electrostatic latent image formed on said electrophotographic photosensitive member, and a developer accommodating portion for accommodating a developer to be supplied to said developing roller; a main assembly; and a supporting member movable between an inside position which is inside said main assembly of the apparatus and in which said supporting member demountably supports said process cartridge and an outside position outside said main assembly, wherein said supporting member includes a contacting and spacing member capable of taking a contacting position for contacting said developing roller to said electrophotographic photosensitive member and a spacing position for spacing said developing roller from said electrophotographic photosensitive member.

According to another aspect of the present invention, there is provided an electrophotographic image forming apparatus comprising: a developing cartridge including a developing roller for developing an electrostatic latent image formed on an electrophotographic photosensitive member while contacting the electrophotographic photosensitive member, and a developer accommodating portion for accommodating a developer to be supplied to said developing roller; a main assembly; and a supporting member movable between an inside position which is inside said main assembly of the apparatus and in which said supporting member demountably supports said developing cartridge and an outside position outside said main assembly, wherein said supporting member includes a contacting and spacing member capable of taking a contacting position for contacting said developing roller to said electrophotographic photosensitive member and a spacing position for spacing said developing roller from said electrophotographic photosensitive member.

In the following, embodiments of the present invention will be described in detail referring to the accompanying drawings. The dimensions, materials, shapes, positional relationships of the constituent elements of the embodiments are not restrictive to the present invention unless otherwise stated.

EMBODIMENT 1

Referring to FIG. 1-FIG. 21, an electrophotographic image forming apparatus (image forming apparatus) according to Embodiment 1 of the present invention will be described.

<General Arrangement of Image Forming Apparatus>

Referring to FIGS. 1 and 2, the description will be made as to the general arrangement of the image forming apparatus according to Embodiment 1 of the present invention. FIG. 1 is a schematic sectional view of the image forming apparatus according to Embodiment 1 of the present invention. FIG. 2 is a schematic sectional view illustrating the state that the drawer unit in the image forming apparatus according to Embodiment 1 of the present invention is drawn.

In an image forming apparatus 100 according to this embodiment, the four electrophotographic photosensitive drums (photosensitive drums 1) juxtaposed horizontally is employed. The photosensitive drum 1 is rotated in the clockwise direction in FIG. 1 by unshown driving means.

The image forming apparatus 100 includes the charging means 2, a scanner unit 3, a development unit 4*y*, 4*m*, 4*c*, 4*k*, and the electrostatic transfer means 5 and so on as electrophotographic image forming process means, in addition to the photosensitive drum 1. The developing units 4*y*, 4*m*, 4*c*, 4*k* maybe simply called developing unit 4 where doing so is clear, although y represents yellow; m represents magenta; c represents cyan; and k represents black.

Here, the charging means 2 has the function of charging a surface of the photosensitive drum 1 uniformly. The scanner unit 3 projects a laser beam onto the photosensitive drum 1 on the basis of image information to form an electrostatic latent image on the surface of the photosensitive drum 1. The developing unit 4 develops the electrostatic latent image formed on the surface of the photosensitive drum 1 using the toner which is a developer. The electrostatic transfer means 5 transfers a toner image on the photosensitive drum 1 onto a sheet material S as a recording material which is a transfer member. Specific examples of sheet material S include the paper, an OHP sheet, and cloth.

The image forming apparatus 100 includes cleaning means 6 for removing the toner which remains on the surface of the photosensitive drum after the transferring 1. Furthermore, the image forming apparatus 100 further includes cleaning means 7 for removing the residual toner deposited on the transfer belt 11 below an electrostatic transfer belt (transfer belt 11) as a transfer member which constitutes electrostatic transfer means 5.

The photosensitive drum 1 includes an aluminum cylinder and an organic photoconductor layer (OPC photosensitive member) applied on an outer surface thereof, for example. The photosensitive drum 1 is supported by an unshown supporting member rotatably at the opposite ends thereof. One of the ends is provided with an unshown drum coupling for receiving a driving force from a driving motor (unshown). By this, the photosensitive drum 1 receives the driving force of the driving motor through the drum coupling to rotate clockwisely in FIG. 1.

The charging means 2 according to this embodiment is means of a contact charging type. More specifically, the charging means 2 is an electroconductive roller in the form of the roller and contacts to the surface of the photosensitive drum 1. A charging bias voltage is applied to this roller, by which the surface of the photosensitive drum 1 is charged uniformly.

The scanner unit 3 is disposed above the photosensitive drum 1. In the scanner unit 3, the image light (laser beam) corresponding to an image signal is emitted from an unshown laser diode and it is incident on the surface of the charged photosensitive drum 1. By this, the electrostatic latent image corresponding to the image signal is formed on the surface of the photosensitive drum 1.

The developing units 4 include the toner containers 41*y*, 41*m*, 41*c*, 41*k* which accommodates the yellow, the magenta, the cyan, and the black toner, respectively. The toner containers 41*y*, 41*m*, 41*c*, 41*k* are the developer accommodating portions which accommodate the developer (toner) to be supplied to the developing roller 40. The toner in the toner containers 41*y*, 41*m*, 41*c*, and 41*k* is fed to a toner supplying rollers 43. The toner is applied to the outer periphery of the developing roller 40, and the charge is applied to the toner, by the toner supplying roller 43 and a developing blade 44 press-contacted to an outer periphery of the developing roller 40.

By applying a developing bias to the developing roller 40, the toner is deposited on a latent image formed on the photosensitive drum 1 to form the toner image. The opposition contact of the developing roller 40 is carried out to the photosensitive drum 1. Here, the developing unit 4 and the photosensitive drum 1 form integral process cartridge P (Py, Pm, Pc, Pk). In the process cartridge P, the toner is consumed with usage, and when the lifetime ends, the process cartridge P can be exchanged (so-called cartridge type).

As shown in FIG. 1, the image forming apparatus 100 includes the transfer belt 11 contacted to the photosensitive drum 1. By the transfer belt 11, the sheet material S is fed to a transfer position, where the toner image formed on the surface of the photosensitive drum 1 is transferred.

The inside of the transfer belt 11 is provided with a transfer roller 12 in a position opposed to the photosensitive drum 1. From the transfer roller 12, positive polarity charge is applied to the sheet material S through the transfer belt 11. By this, the toner image (developer image) on the photosensitive drum 1 is transferred to the sheet material S.

The image forming apparatus 100 includes a feeding portion 16 for feeding the sheet material S to an image forming station. The feeding portion 16 includes a feeding cassette 17 for accommodating a plurality of sheet S. At the time of the image formation, a feeding roller 18 and a registration roller couple 19 rotate in accordance with the image forming operation. By this, the sheet material S is fed one by one from the cassette 17. In synchronism with the rotation of the transfer belt 11 and the toner image, the sheet material S is fed by the registration roller pair 19 to the transfer belt 11.

Furthermore, the image forming apparatus 100 includes a fixing portion 20 for fixing a plural color toner image transferred onto the sheet material S. The fixing portion 20 comprises a rotatable heating roller 21*b* and a pressing roller 21*a* press-contacted to it. While the sheet material S onto which the toner image on the photosensitive drum 1 is transferred is nipped between the heating roller 21*b* and the pressing roller 21*a*, it is fed, during which the heat and a pressure are applied to the toner. By this, the plural color toner image is fixed on the surface of the sheet material S.

An image forming process is as follows. When the image forming operation is started, the photosensitive drum 1 is rotated. The charging means 2 applies the charge uniformly to the surface of the photosensitive drum 1, and the scanner unit 3 exposes the surface of the photosensitive drum 1 to the image light in response to the image signal to form an electrostatic latent image on the surface of the photosensitive drum 1. The developing roller 40 develops the electrostatic latent image (With the toner).

On the other hand, to the sheet material S fed by the transfer belt 11 from the feeding portion 16, the toner images formed on the surfaces of the photosensitive drums 1 is sequentially transferred by the electric fields formed between the photosensitive drums 1 and the transfer rollers 12. The sheet material S onto which the four color toner images are transferred is fed to the fixing portion 20. A color image is fixed with the fixing portion 20, and the sheet material S is discharged from a discharging portion 24 to an outside of the device by a discharging roller pair 23.

<Drawer Member (Supporting Member)>

A drawer member 13 will be described. It is a supporting member, and is movable between an inside position dismountably supporting the process cartridge and an outside position of the outside of the main assembly.

Here, in this embodiment, the main assembly is the portion other than at least drawer member 13 and the members (parts) which are detachably mountable thereto or fixed thereto, among the various members (parts) which constitute the image forming apparatus 100.

As shown in FIG. 2, the drawer member 13 is movable linearly in the substantially horizontal direction (arrows D1 and D2 directions) relative to the main assembly (insertable and drawable). The drawer member 13 can be moved to the position (FIG. 1) in which it is accommodated in an inside of the main assembly and the position (FIG. 2) in which it is drawn to an outside the main assembly.

In the state that the drawer member 13 is in a drawn-out position, the process cartridges P (Py, Pm, Pc, Pk) is mounted by the user to the drawer member 13 in the substantially vertical direction (the direction of arrow C in FIG. 2). In the process cartridge P mounted in this manner, a longitudinal direction (an axial direction of the developing roller 40) thereof is perpendicular to a movement direction of the drawer member 13. The four process cartridges Py, Pm, Pc, Pk are juxtaposed in the movement direction of the drawer member 13.

In the state that such process cartridges P are mounted to the drawer member 13, they are moved into the main assembly with the drawer member 13. In the state that the drawer member 13 is in the main assembly, when a door 10 is closed, all the process cartridges are mounted to the predetermined positions in the main assembly P.

In this manner, according to the image forming apparatus 100 according to this embodiment, four process cartridge Ps can be mounted into the main assembly all together, and four process cartridges Ps can be drawn all together to the outside of the main assembly. Therefore, the operativity in the exchange of process cartridge P is excellent, as compared with the case in which the process cartridges are mounted into the main assembly individually.

<Mounting Portion of Drawer Member (Supporting Member)>

Referring mainly to FIGS. 3 and 4, the structures of the mounting portion for the drawer member 13 in the main assembly will be described. FIGS. 3 and 4 are a perspective views illustrating the mounting portion for the drawer member in the main assembly of the image forming apparatus according to Embodiment 1 of the present invention. In FIGS. 3 and 4, the scanner unit 3 and so on are omitted among the members (parts) which constitute the main assembly, for better understanding of the structure of the mounting portion. FIG. 3 and FIG. 4 are the perspective views as seen in different directions.

On an inner wall surface of a main assembly frame, the pair of guide portions 14R, 14L which guide the movement direction of the drawer member 13 is provided opposed to each other. The guide portions 14R, 14L have the function of guiding the portions-to-be-guided 13*a*, 13*b*, 13*c*, and 13*d* (FIG. 5 and FIG. 6) of the drawer member 13 as will be described hereinafter, and have a channel-like section. The guide portions 14R, 14L are extended in the substantially horizontal direction from the neighborhood of an entrance of the main assembly (neighborhood of the door 10) to a rear side, so that the drawer member 13 can be guided from the position for drawing to an outside of the main assembly to the position of being accommodated in the inside of the main assembly.

Above the guide portions 14R, 14L, urging members 65, 66 for pressing and positioning the process cartridge P to the predetermined position is provided. These urging members 65, 66 press process cartridge P, by moving downwardly with the driving force from a main assembly side, and, thereby to position the process cartridge P in the predetermined position in the main assembly.

As shown in FIG. 4, below a guide portion 14L, a drum coupling member 25 for transmitting a drive to a photosensitive drum 1 and a development coupling member 26 for transmitting the drive to the developing roller 40 are provided, and they are disposed at equal intervals in the horizontal direction. The drum coupling member 25 and the development coupling member 26 transmit the driving forces from an unshown driving source to the process cartridge P. In the state where the door 10 is opened, the drum coupling member 25 and the development coupling member 26 are in the state of retracting in the inside, and they enter into process cartridge P in interrelation with the closing operation of the door 10.

As shown in FIG. 4, furthermore, the rear side of the guide portion 14L is provided with a driving gear 46 for applying the driving force for moving the contacting and spacing member 42 as will be described hereinafter.

<Drawer Member (Supporting Member)>

The drawer member 13 will be described in detail referring mainly to FIGS. 5 and 6. FIGS. 5 and 6 are perspective views of the drawer unit in the image forming apparatus according to Embodiment 1 of the present invention. FIG. 5 and FIG. 6 are the perspective views, as seen from the different directions.

Four corners of the drawer member 13 are provided with the portions-to-be-guided 13*a*, 13*b*, 13*c*, 13*d* for being guided by the guide portions 14R, 14L of the main assembly. The portions-to-be-guided 13*a*, 13*c* are guided by the guide portion 14R, and the portions-to-be-guided 13*b*, 13*d* is guided by the guide portion 14L. The portions-to-be-guided 13*a*, 13*b* project from the outside of a side surface, and are extended in a drawing direction so that the drawer member 13 does not incline in the drawn-out position. The portions-to-be-guided 13*c*, 13*d* have cylindrical shapes and project from the outside of the side surface.

The one end portion of the drawer member 13 is provided with a grip portion 28 for the convenience at the time of the user operating the drawer unit U1.

Furthermore, the drawer member 13 is provided with the mounting portions 13*f* for mounting the process cartridge s P, as will be described hereinafter in an array. A partition plate 13*g* is provided between the mounting portions 13*f*, and a rough index at the time of mounting process cartridge P is provided. Lower portions of the mounting portions 13*f* are provided with opening portions 13*e*, respectively. Through these opening portions 13*e*, the photosensitive drum 1 provided in the process cartridge P can be contacted to the transfer belt 11.

The one-end portions and the other end portions of the mounting portion 13*f* is provided with the guide portions 13*h*, 13*i*, 13*j*, 13*k* for mounting the process cartridge s P to the inside of the drawer member 13. The lower portions of the guide portions 13*h*, 13*j* are provided with positioning portions 13*h*1, 13*j*1 for positioning the process cartridge P relative to the drawer member 13.

As shown in FIG. 5, the drawer member 13 is provided with an opening portion 13*m* for the entrance of the drum coupling member 25 and an opening portion 13*l* for the entrance of the development coupling member 26. The drum coupling member 25 and the development coupling member 26 enter the opening portion 13*m* and the opening portion 13*l* in interrelation with the closing operation of the door 10. The drum coupling member 25 and the development coupling member 26 which entered these opening portions 13*m*, 13*l* engage with the coupling member of the process cartridge P to enable the transmission of the drive to the process cartridge P.

One of the side surfaces of the drawer member 13 is provided with a contacting and spacing member 42. The contacting and spacing member 42 is extended along the movement direction of the drawer member 13, and is movable in the movement direction (direction of arrow D in FIG. 5) of the drawer member 13. A rear end portion of the contacting and spacing member 42 is provided with a rack portion 42*a* as a driving force receiving portion for receiving the driving force for the movement of the contacting and spacing member 42 from the driving gear 46 (FIG. 4).

The contacting and spacing member 42 is provided with a projection-recess configuration (first projection (force applying portion) 42*b*, second projection (force applying portion) 42*c*, and recess 42*d*) along the longitudinal direction thereof. The first projection (force applying portion) 42*b* of the contacting and spacing member 42 has a function of spacing the photosensitive drum 1 from the transfer belt 4. The second projection (force applying portion) 42*c* further projects beyond a first projection 42*b*, and has the function of spacing the developing roller 40 from the photosensitive drum 1. The details thereof will be described hereinafter. The recess 42*d* recessed from the projections is provided between the first projection 42*b* and the second projection 42*c*.

As has been described in the foregoing, the drawer unit U1 comprises the drawer member 13 and the contacting and spacing member 42.

<Process Cartridge>

Referring to FIG. 7-FIG. 9, the description will be made as to the process cartridge P mounted to the drawer member 13. FIG. 7 is a schematic sectional view of the process cartridge according to Embodiment 1 of the present invention. FIG. 8 is a perspective view of the process cartridge according to Embodiment 1 of the present invention. FIG. 9 is a perspective view illustrating the state that the process cartridge according to Embodiment 1 of the present invention is mounted to the drawer unit (drawer member).

The process cartridge P comprises a photosensitive member unit 8 and developing unit 4. The photosensitive member unit 8 comprises the photosensitive drum 1, charging means 2, cleaning means 6, and a residual toner container 30 for containing the toner removed by the cleaning means 6. The developing unit 4 comprises the developing roller 40, a toner supplying roller 43, a developing blade 44, and the toner container 41 which contains the toner used for the image formation.

As has been described hereinbefore, the toner in the toner container 41 is fed to the toner supplying roller 43. By the toner supplying roller 43 and the developing blade 44 press-contacted to the outer periphery of the developing roller 40, the toner is applied to the outer periphery of the developing roller 40, and the charge is applied to the toner. By applying the developing bias from the main assembly to the developing roller 40, the toner is deposited onto the latent image formed on the photosensitive drum 1 to form the toner image. The toner image developed on the photosensitive drum 1 is transferred onto the sheet material S, and thereafter the toner which remains on the photosensitive drum 1 surface is removed by the cleaning means 6 and is accommodated in the residual toner container 30.

Here, when the toner in the toner container 41 is consumed up, the user exchanges process cartridge P, by which the user can carry out the printing again.

As shown in FIG. 8, the one-end portion of the process cartridge P supports a coupling member 47 for receiving the driving force from the drum coupling member 25 of the main assembly side rotatably. It also supports a coupling member 45 for receiving the driving force from the development coupling member 26 rotatably.

The coupling member 47 is provided at the end of the photosensitive drum 1, and the photosensitive drum 1 is rotated by the driving force received by the coupling member 47 from the main assembly. The driving force received by the coupling member 45 is transmitted to the developing roller 40 and the toner supplying roller 43 through an unshown intermediate gear to rotate them.

The outer periphery of the coupling member 45 is covered by a cylindrical rib and constitutes an engaging portion 71*a*. The engaging portion 71*a* is provided on a side cover 71 fixed to the outside of the toner container 41. The coupling member 45 is rotatable relative to the engaging portion 71*a*. As shown in FIG. 9, an engaging portion 70*a* is provided on the opposite side from the engaging portion 71*a*. This engaging portion 70*a* is similarly provided on a side cover 70. These engaging portions 71*a*, 70*a* are provided on the developing unit 4.

The residual toner container 30 is provided with hole portions 30*a*, 30*b* supporting the engaging portions 71*a*, 70*a*. The hole portions 30*a*, 30*b* provided in the residual toner container 30 engage with the engaging portions 71*a*, 70*a* provided in the developing unit 4, by which the photosensitive member unit 8 and the developing unit 4 connect with each other.

Here, the engaging portions 71*a*, 70*a* are movable (rotatable) relative to the hole portions 30*a*, 30*b* respectively, and therefore, the developing unit 4 can be moved relative to the photosensitive member unit 8. That is, the developing roller 40 is movable relative to the photosensitive drum 1.

As shown in FIG. 7-FIG. 9, between the photosensitive member unit 8 and the developing unit 4, a spring 9 as an urging member is provided. The spring 9 presses the developing roller 40 with the predetermined pressure to the photosensitive drum 1. When the developing unit 4 moves in the direction of separating the developing roller 40 from the photosensitive drum 1 relative to the photosensitive member unit 8, it moves against an urging force of the spring 9.

As shown in FIG. 8, the outer periphery of the coupling member 47 is covered by the cylindrical rib to form a portion-to-be-guided 30*c*. As shown in FIG. 9, a portion-to-be-guided 30*d* in the form of a cylindrical projection is provided on the opposite side of the portion-to-be-guided 30*c* with respect to the longitudinal direction. As shown in FIG. 8, a portion-to-be-guided 30*e* is provided above the portion-to-be-guided 30*c*, and as shown in FIG. 9, a portion-to-be-guided 30*f* is provided above the portion-to-be-guided 30*d*. The portions-to-be-guided 30*c*, 30*d*, 30*e*, 30*f* has the function of the guide for the mounting, into the drawer member 13, of the process cartridge P, and have a function of positioning the process cartridge P in the drawer member 13. The details thereof will be described hereinafter.

As shown in FIG. 8, an upper portion of one of the lateral sides of the photosensitive member unit, 8 is provided with an outwardly projecting force receiving portion 30*g* with respect to an axial direction of the photosensitive drum 1. The force receiving portion 30*g* receives the force from the contacting and spacing member 42 provided in the drawer member 13 to space the photosensitive drum 1 from the transfer belt 11. The details thereof will be described hereinafter. As shown in FIG. 9, furthermore, an upper portion of the other side surface of the photosensitive member unit 8 is provided with a force receiving portion 30*h*. The force receiving portions 30*g*, 30*h* receive a force from the urging members 65, 66 as will be described hereinafter to position the process cartridge P in the drawer member 13.

As shown in FIG. 8, an outwardly projecting force receiving portion, 71*b* with respect to the axial direction of the developing roller 40 is provided above the side cover 71 of the developing unit 4. The force receiving portion 71*b* receives the force from the contacting and spacing member 42 to space the developing roller 40 from the photosensitive drum 1. The details thereof will be described hereinafter.

<Mounting of Process Cartridge to Drawer Member>

Referring to FIG. 9-FIG. 11, the description will be made as to the mounting of process cartridges P (Py, Pm, Pc, Pk) to the drawer member 13. The FIGS. 9 and 10 are the perspective views illustrating the state that the process cartridge according to Embodiment 1 of the present invention is mounted to the drawer member. The FIG. 9 and FIG. 10 (*a*) show the mounting process of the process cartridge and are views, as seen from different directions. In FIG. 10 (*b*), all the process cartridges are mounted. FIG. 11 is a schematic view showing the state that the process cartridge is mounted to the drawer member. FIG. 11 (*a*) is a side view, and FIG. 11 (*b*) is a schematic longitudinal sectional view.

The process cartridges Py, Pm, Pc, Pk are mounted into the four mounting portions 13*f* (FIG. 5) provided in the drawer member 13, respectively. The user mounts the process cartridge P in a direction of the arrow C which is substantially the direction of gravity.

In mounting the process cartridge P, first, the user moves it, so that the portions-to-be-guided 30*c*, 30*d* provided at the opposite ends of the process cartridge P are guided by the guide portions 13*h*, 13*j* of the drawer member 13. Then, the user moves it, so that the portions-to-be-guided 30*e*, 30*f* are guided by the guides 13*i*, 13*k*. By this, the process cartridge P is mounted to the inside of the drawer member 13, while being guided by the guide portions 13*h*, 13*i*, 13*j* and 13*k*.

In the process in which the process cartridge P is mounted to the drawer member 13, the force receiving portion 30*g* provided on the photosensitive member unit 8 abuts to the first projection (force applying portion) 42*b* provided on the contacting and spacing member 42. The force receiving portion 71*b* provided on the side cover 71 of the developing unit 4 abuts to the second projection (force applying portion) 42*c*.

The force receiving portion 30*g* provided on the photosensitive member unit 8 abuts to the first projection 42*b*, by which the process cartridge P is held in a position higher than the image forming position. As shown in FIG. 2, that is, the surface of the photosensitive drum 1 is held in the (spacing) position higher than the surface (recording material conveying surface) of the transfer belt 11.

Here, the contacting and spacing member 42 is provided only at one-end portion of the drawer member 13. The force receiving portion 30*g* for receiving the force from the first projection 42*b* of the contacting and spacing member 42 is also provided only at the one side of the photosensitive member unit 8. However, the portion-to-be-guided 30*d* provided at the other end portion of the process cartridge P is provided in the outside of the widthwise end of the transfer belt 11, and therefore, the surface of the photosensitive drum 1 can be separated from the surface of the transfer belt 11. That is, as for the process cartridge P, the force receiving portion 30*g* receives the force from first projection 42*b* in the one-end portion to rise. On the other hand, the state that the portion-to-be-guided 30*d* is in contact to a positioning portion 13*j*1 of the drawer member 13 is maintained in the other end portion. For this reason, the process cartridge P is oblique relative to the transfer belt 11. However, as has been described hereinbefore, the portion-to-be-guided 30*d* is provided to the outside of the widthwise end of the transfer belt 11, and therefore, the surface of the photosensitive drum 1 is spaced from the surface of the transfer belt 11.

By the force receiving portion 71*b* provided on the developing unit 4 contacting to the second projection 42*c* provided on the contacting and spacing member 42, the surface of the developing roller 40 is spaced from the surface of the photosensitive drum 1. Referring mainly to FIG. 11, the description will be made.

The second projection 42*c* provided on the contacting and spacing member 42 is higher than the first projection 42*b*. On the other hand, the force receiving portion 30*g* provided on the photosensitive member unit 8 and the force receiving portion 71*b* provided on the developing unit are substantially at the same level in the state of not receiving an external force. Therefore, the force receiving portion 71*b* abutted to the second projection 42*c* receives the weight of the developing unit 4 to space the surface of the developing roller 40 from the surface of the photosensitive drum 1 against the force of the urging member 9. That is, by the force receiving portion 71*b* receiving the force, the engaging portions 71*a*, 70*a* provided on the developing unit 4 rotates about the hole portions 30*a*, 30*b* provided in the photosensitive member unit 8, respectively.

At this time, the contacting and spacing member 42 is in such a position that the first projection 42*b* contacts to the force receiving portion 30*g*, and the second projection 42*c* contacts to the force receiving portion 71*b*. At this time, the surface of the developing roller 40 can be placed in the position spaced from the surface of the photosensitive drum 1. This position is a spacing position, wherein the contacting and spacing member 42 can isolate the photosensitive drum 1 from the transfer belt 11, and can space the developing roller 40 from the photosensitive drum 1.

In the case where the drawer member 13 is in the state of being drawn from the main assembly, that is, inn the case where the drawer member 13 is positioned in the outside of the main assembly (outside position), the contacting and spacing member 42 is placed in the spacing position. As shown in FIG. 11, for this reason, when the process cartridge P is mounted to the drawer member 13, the surface of the developing roller 40 is spaced from the surface of the photosensitive drum 1 together with the mounting operation. Therefore, in mounting the process cartridge P to the drawer member 13 it can be avoided that the surface of the photosensitive drum 1 and the surface of the developing roller 40 are rubbed with each other by the impact at the time of the mounting, and these surfaces are damaged.

As has been described in the foregoing, in mounting the process cartridge P to the drawer member 13, the state that the surface of the developing roller 40 is spaced from the surface of the photosensitive drum 1 is maintained. In addition, the state that the surface of the photosensitive drum 1 is spaced from the surface of the transfer belt 11 is maintained.

<Mounting of Drawer Unit into Main Assembly>

Referring to FIG. 12-FIG. 15 the description will be made as to the mounting operation of the drawer unit U1 into the main assembly. FIG. 12 is a perspective view illustrating the state that the drawer unit according to Embodiment 1 of the present invention is mounted to the inside of the main assembly. FIG. 13 is a schematic sectional view illustrating the state that the drawer unit according to Embodiment 1 of the present invention is mounted to the inside of the main assembly. FIG. 14 is a schematic sectional view illustrating the state that the drawer unit according to Embodiment 1 of the present invention is mounted to the inside of the main assembly, and the door is open. FIGS. 13 and 14 include the enlarged cross-sectional views of the schematic sectional views of the whole device and the neighborhood of the one photosensitive drum. FIG. 15 is a schematic sectional view illustrating the state that the drawer unit according to Embodiment 1 of the present invention is mounted to the inside of the main assembly, and the door closes. FIG. 15, the state that the image forming operation is not carried out is shown.

As shown in FIG. 12, the drawer unit U1 is mounted in a direction of arrow E while the portions-to-be-guided 13*a*, 13*b*, 13*c*, and 13*d* (FIGS. 5, 6) of the drawer member 13 is guided by the guide portions 14R and 14L of the main assembly (FIGS. 3, 4).

During the mounting operation of the drawer unit U1 (drawer member 13), the state that the surface of the photosensitive drum 1 and a recording material conveying surface 11*a* of the transfer belt 11 are spaced from each other are maintained. That is, a gap g is provided between the surface of the photosensitive drum 1 and the recording material conveying surface 11*a* of the transfer belt 11. Therefore, the drawer unit U1 can be mounted to the inside of the main assembly without the rubbing between the surface of the photosensitive drum 1 and the surface of the transfer belt 11. During the mounting operation, the drawer unit U1 is moved in substantially parallel with the recording material conveying surface 11*a* of the transfer belt 11.

As has been described hereinbefore, during the mounting operation of the drawer unit U1, the separation member 14 is placed in the spacing position, the state of spacing the surface of the photosensitive drum 1 and the developing roller 40 from each other is maintained. That is, a gap h is provided between them. Therefore, in mounting the drawer unit U1 which carries the process cartridge P to the inside of the main assembly, the damage due to the contact between the surface of the photosensitive drum 1 and the surface of the developing roller 40 by the impact at the time of the mounting or the like is suppressed.

When the drawer unit U1 is mounted to the inside of the main assembly, the rack portion 42*a* (FIG. 10) provided on the contacting and spacing member 42 and the driving gear 46 of the main assembly (FIG. 4) engage with each other. By this, the driving force is transmittable to the rack portion 42*a* from the driving gear 46.

As shown in FIG. 14, in the state that the drawer unit U1 is completely inserted into the main assembly, and the door 10 is open, the surface of the photosensitive drum 1 and the recording material conveying surface 11*a* of the transfer belt 11 are still spaced from each other. The surfaces of the photosensitive drum 1 and the developing roller 40 are spaced from each other similarly.

In the state of FIG. 15, the door is closed. By the closing operation of the door 10, the drum coupling member 25 and the development coupling member 26 (FIG. 4) enter the opening portion 13*m* and 13*l* of the opening portion (FIG. 5) provided in the drawer member 13, respectively. However, the process cartridge P is not placed in a regular position (the operative position for the image formation) as yet. Therefore, the drum coupling member 25 and the development coupling member 26 are not in engagement with the coupling members 47 and 45 (FIG. 8).

Also in the state where the door 10 is closed, when the image forming operation is not carried out, the spaced state is maintained between the surface of the photosensitive drum 1 and the recording material conveying surface 11*a* of the transfer belt 11, and between the surface of the photosensitive drum 1 and the surface of the developing roller 40. That is, the contacting and spacing member 42 is placed in the spacing position.

In such a state, apparatus is maintained until the instruction of the image forming operation is produced from the main assembly.

<Operations at the Time of Image Forming Operation>

Referring to FIG. 16-FIG. 21 the description will be made as to the operation of each part at the time of the image forming operation. FIG. 16 is a perspective view illustrating the state immediately after the image formation instruction in the drawer unit according to Embodiment 1 of the present invention. FIG. 17 is a schematic sectional view illustrating the state in which the drawer unit according to Embodiment 1 of the present invention is mounted to the inside of the main assembly, and in which it is of partway of shifting to the image forming operation. FIG. 17 includes a schematic sectional view of the neighborhood of the drawer unit and the transfer belt and an enlarged cross-sectional view of the neighborhood of the one photosensitive drum. FIG. 18 is a perspective view illustrating the state of the partway of shifting to the image forming operation in the drawer unit according to Embodiment 1 of the present invention. FIG. 19 is a schematic sectional view illustrating the state of the partway of shifting to the image forming operation in the image forming apparatus according to Embodiment 1 of the present invention. FIG. 19 includes a schematic sectional view of the whole device and an enlarged cross-sectional view of the neighborhood of the one photosensitive drum. FIG. 20 is a perspective view illustrating the state in the course of shifting to the image forming operation in the drawer unit according to Embodiment 1 of the present invention. FIG. 21 is a schematic sectional view illustrating the state that the image forming operation is capable in the image forming apparatus according to Embodiment 1 of the present invention. FIG. 21 includes an enlarged cross-sectional view of a schematic sectional view of the whole device and the neighborhood of one photosensitive drum.

The instruction of the image formation is produced, the driving gear 46 connected operatively with a motor (unshown) provided in the main assembly is rotated in a direction of arrow F in FIG. 16. By this, the contacting and spacing member 42 is moved in the direction of arrow G in the Figure by the rack portion 42*a* engaged with the driving gear 46. When the contacting and spacing member 42 move to the position shown in FIG. 16, the force receiving portion 30*g* provided on the photosensitive member unit 8 separates from the first projection 42*b* of the contacting and spacing member 42. However, the force receiving portion 71*b* provided in the developing unit 4 is still placed on the second projection 42*c*. Since the second projection 42*c* is longer than the first projection 42*b*, such a mechanism is established in the movement direction of the contacting and spacing member 42.

FIG. 17 shows a positional relation among the drawer member 13, the process cartridge P, and the transfer belt 11 in the state shown in FIG. 16. As has been described hereinbefore, the force receiving portion 30*g* separates from the first projection 42*b* by a moving operation of the contacting and spacing member 42, by which the surface of the photosensitive drum 1 is contacted to the surface of the transfer belt 11. On the other hand, the force receiving portion 71*b* is maintained in the state of receiving the force from the second projection 42*c*, and therefore, the developing roller 40 is spaced from the surface of the photosensitive drum 1. Here, the space is maintained between the surface of the photosensitive drum 1 and the surface of the developing roller 40, and therefore, the contacting and spacing member 42 takes the spacing position.

As shown in FIG. 18, thereafter, the urging members 65, 66 provided in the main assembly side are driven with the unshown driving source and moves in a direction of arrow H. The urging members 65, 66 abut to the force receiving portions 30*g*, 30*h* provided on the process cartridge P and apply the force to it. By this, the portion-to-be-guided 30*c* (FIG. 8) of the process cartridge P abuts to the positioning portion 13*h*1 (FIG. 9) provided on the drawer member 13. The portion-to-be-guided 30*d* (FIG. 9) abuts to the positioning portion 13*j*1 (FIG. 10). Furthermore, the portions-to-be-guided 30*e* and 30*f* (FIGS. 8, 9) engage with the guide portions 13*i* and 13*k* (FIGS. 9, 10), and the process cartridge P is positioned in the drawer member 13.

As has been described in the foregoing, by the function of the urging members 65, 66, the process cartridge P is positioned in the main assembly.

FIG. 19 shows the inside a main assembly in the state shown in FIG. 18. In the process cartridge P in this state, the surface of the developing roller 40 is spaced from the surface of the photosensitive drum 1. The surface of the photosensitive drum 1 is kept spaced from the surface of the transfer belt 11. That is, the position of the contacting and spacing member 42 at this time corresponds to the spacing position.

As shown in FIG. 20, thereafter, in order to contact the developing roller 40 and the photosensitive drum 1 relative to each other, the driving gear 46 further rotates and moves the contacting and spacing member 42 in a direction of arrow G. By this, the force receiving portion 71*b* provided on the developing unit 4 separates from the second projection 42*c* of the contacting and spacing member 42 and does not receive the force from the second projection 42*c*. Therefore, the surface of the developing roller 40 and the surface of the photosensitive drum 1 contact to each other by the urging force of the spring 9 provided between the developing unit 4 and the photosensitive member unit 8. By this, as for the image forming apparatus 100, the image formation is enabled. This position is a contacting position, wherein the contacting and spacing member 42 contacts the developing roller 40 to the photosensitive drum 1 to enable the image formation. The image forming operation is as has been described hereinbefore. FIG. 21 shows the inside of the main assembly at the time of being in the state that the image forming operation is capable.

When the image formation finishes, the driving gear 46 is rotated in the direction opposite the direction of arrow F shown in FIG. 16 to move the contacting and spacing member 42 in the direction of arrow I in FIG. 20. By this, the contacting and spacing member 42 is moved to the spacing position, and spaces the surface of the developing roller 40 from the surface of the photosensitive drum 1 (FIGS. 18, 19).

Thereafter, the urging members 65, 66 carry out in movement in the direction opposite the above described pressing direction, and the contacting and spacing member 42 further moves in a direction of arrow I. By this, the surface of the photosensitive drum 1 is spaced from the surface of the transfer belt 11. In this state, the apparatus waits for the instruction of the next image formation. Or, in the case where the drawer member 13 is drawn, the state is maintained in which the surface of the photosensitive drum 1 and the surface (recording material conveying surface 11*a*) of the transfer belt 11 are spaced from each other and the surface of the photosensitive drum 1 and the surface of the developing roller 40 are spaced from each other. That is, the contacting and spacing member 42 is placed in the spacing position. Therefore, when the drawer member 13 which carries the process cartridge P is drawn from the main assembly, the damage due to the contact between the surface of the photosensitive drum 1 and the surface of the developing roller 40 by the impact at the time of the movement or the like is suppressed.

As has been described in the foregoing, according to the image forming apparatus 100 of this embodiment, the contacting and spacing member is movable between the spacing position and the contacting position And, by the movement of the contact member 42, the developing roller 40 moves timely to the position of spacing from the photosensitive drum 1 or the position of contacting to the photosensitive drum 1. By this, the state of the developing roller 40 not contacting to the photosensitive drum 1 can be established, when the image forming operation is not carried out, namely, during drawing the drawing unit U1 (drawer member 13) outwardly, and so on. Therefore, the deteriorations of various members can be suppressed, and the service lives can be extended.

In addition, the image forming apparatus 100 according to this embodiment employs a structure in which the drawer member 13 is provided with the contacting and spacing member 42. Therefore, the structure for advancing the contacting and spacing member from the main assembly side of the apparatus into the drawer member is not necessitated unlike in the conventional example in which the contacting and spacing member for spacing the developing roller from the photosensitive drum is provided in the main assembly side of the apparatus. In other words, no space is required to move the contacting and spacing member from the main assembly side of the apparatus to the position of the cartridge in the drawer member, and therefore, the main assembly of the apparatus can be downsized.

It would be considered that the contacting and spacing member is fixed to the main assembly side of the apparatus, and a force receiving portion of the drawer member provided in the cartridge receives a force from the contacting and spacing member by a pushing-in operation and a drawing operation to contact and space the developing roller relative to the photosensitive drum.

However, even when such a structure is employed, it is necessary to project the force receiving portion out of the drawer member in order to make the force receiving portion of the cartridge contactable to the contacting and spacing member. Therefore, the apparatus is not downsized enough. According to this embodiment, however, the contacting and spacing member 42 is provided in the drawer member 13, and therefore, it is unnecessary to project the force receiving portion 71*b* too much, and the process cartridge P can be downsized.

Even when such structures are employed, the cartridge has to be mounted in the state that the force receiving portion of the cartridge is retracted from the contacting and spacing member, in order to contact the force receiving portion of the cartridge to the contacting and spacing member at the desired timing. And, the result is that the structure or mechanism is required to move the entire drawer member to the position where the force receiving portion of the cartridge contacts to the contacting and spacing member. According to this embodiment, however, the contacting and spacing member 42 is provided in the drawer member 13, and therefore, the structure of the main assembly of the apparatus can be simplified and downsized.

In this embodiment, as for the example of the transfer belt 11, the sheet material S which is the transfer member is fed to the surface of the photosensitive drum 1, and the developer image on the photosensitive drum 1 is directly transferred onto the sheet material S. However, the present invention is applicable also to the image forming apparatus, wherein the transfer belt receives the developer image formed on the photosensitive drum and, finally the image is transferred onto the recording material (sheet material) (intermediary transfer belt type).

In this embodiment, the contacting and spacing member 42 is provided only at the one-end portion of the drawer member 13. However, a contacting and spacing member may also be provided like the other end portion of the drawer member 13. In this case, the force receiving portion for receiving the force from the contacting and spacing member is also provided in the other end portion. If the contacting and spacing member is provided at the respective sides, the shafts of the photosensitive drum and the developing roller in the process cartridge do not incline during the movement thereof. Therefore, the spaced state between the photosensitive drum and the transfer belt and the spaced state between the photosensitive drum and the developing roller can further be stabilized.

Embodiment 2

FIG. 22-FIG. 36 illustrates the various parts by Embodiment 2 of the present invention. In Embodiment 1, the process cartridge P which contains the photosensitive member unit 8 which includes the photosensitive drum 1 and the developing unit 4 which includes the developing roller 40 integrally is mounted to the drawer member 13. In this embodiment, a photosensitive member unit which includes the photosensitive drum 1 and the developing unit which includes the developing roller 40 are mounted individually to a drawer member 63. The like reference numerals as in the foregoing embodiment are assigned to the elements having the corresponding functions.

<Developing Cartridge>

Referring to FIG. 22, the description will be made as to the developing cartridge which is the developing unit according to Embodiment 2 of the present invention. FIG. 22 is a perspective view of the developing cartridge according to Embodiment 2 of the present invention. In FIG. 22, they are perspective views, as seen from the different directions ((a) and (b)).

A developing cartridge 60 according to this embodiment comprises the developing roller 40, a toner supplying roller (unshown), a developing blade (unshown), and a toner container 41 which contains the toner which is the developer used for the image formation. In the image forming apparatus according to this embodiment, the four developing cartridge s 60 which contain the toner of the different color are used. The reference numerals for these cartridges are 60*y*, 60*m*, 60*c*, and 60*k* but the reference numerals maybe simply "60" if no confusion arises. Here, y means the yellow, m means the magenta, c means the cyan, and k means the black.

As shown in FIG. 22, the one-end portion of the developing cartridge 60 rotatably supports the coupling member 45 for receiving the driving force from the development coupling member 26 of the main assembly side. The driving force received by the coupling member 45 is transmitted to the developing roller 40, the toner supplying roller, and so on through the unshown intermediate gear.

The upper portion of the side cover, 61 of one side of the developing cartridge 60 is provided with an outwardly projecting force receiving portion 61*a* with respect to the axial direction which is the developing roller 40. This force receiving portion 61*a* receives the force from the contacting and spacing member 42 (FIG. 24) to space the developing roller 40 from the photosensitive drum 1. The details thereof will be described hereinafter. Furthermore, the upper portion of a side cover 62 of the another side of the developing cartridge 60 is provided with a force receiving portion 62*a*. The force receiving portions 61*a*, 62*a* is pressed by the urging members provided in the main assembly to position the developing cartridge 60 relative to the drawer member 63. The details thereof will be described hereinafter.

Adjacent to the force receiving portions, 61*a*, 62*a*, a portions to be positioned 61*b*, 62*b* are provided, and they outwardly project with respect to the axial direction which is the developing roller 40. The details thereof will be described hereinafter.

<Photosensitive Member Cartridge>

Referring to FIG. 23 the description will be made as to the photosensitive member cartridge which is the photosensitive member unit according to Embodiment 2 of the present invention. FIG. 23 is a perspective view of the photosensitive member cartridge according to Embodiment 2 of the present invention. In FIG. 23, they are the perspective views, as seen from the different directions ((a) and (b)).

A photosensitive member cartridge 50 according to this embodiment comprises the photosensitive drum 1, the charging means 2, the cleaning means (unshown), and a residual toner container 31 for containing the toner removed by the cleaning means. As for the image forming apparatus according to this embodiment, the four photosensitive member cartridge s 50 which contain the toner of the different color are used. The reference numerals for these cartridges are 50*y*, 50*m*, 50*c*, and 50*k* but the reference numerals maybe simply 50 if no confusion arises, although y means yellow, m means magenta, c means cyan, and k means black.

As shown in FIG. 23, one-end portion of the photosensitive member cartridge 50 supports the coupling member 47 for receiving the driving force from the drum coupling member 25 of the main assembly side rotatably. The coupling member 47 is provided at the end of the photosensitive drum 1, and the photosensitive drum 1 rotates by the driving force received by the coupling member 47 from the main assembly side.

An outer periphery of the coupling member 47 is covered by the cylindrical rib to constitute a portion-to-be-guided 31*a*. On the opposite side of the portion-to-be-guided 31*a*, a portion-to-be-guided 31*b* which is provided with the cylindrical projection is provided. Above the portion-to-be-guided 31*a*, a portion-to-be-guided 31*c* is provided, and above the portion-to-be-guided 31*b*, a portion-to-be-guided 31*d* is provided. The portions-to-be-guided 31*a*, 31*b*, 31*c*, 31*d* has the guiding function, when the photosensitive member cartridge 50 is mounted into the drawer member 63 and when it is positioned in the drawer member 63. The details thereof will be described hereinafter.

One of the upper portions of the ends of the photosensitive member cartridge, 50 is provided with a force receiving portion 31*e* outwardly projected with respect to the axial direction from the photosensitive drum 1. The force receiving portion 31*e* receives the force from the contacting and spacing member 42 (FIG. 24) provided in the drawer member 63 to space the photosensitive drum 1 from the transfer belt 11. The details thereof will be described hereinafter. Furthermore, the other end of the photosensitive member cartridge 50 is provided with a force receiving portion 31*f*. The force receiving portions 31*e*, 31*f* is pressed by the urging members provided in the main assembly, to position the photosensitive member cartridge 50 relative to the drawer member 63. The details thereof will be described hereinafter.

<Drawer Member (Supporting Member)>

Referring to FIGS. 24 and 25 the description will be made as to the drawer member 63 according to Embodiment 2 of the present invention. The FIGS. 24 and 25 are the perspective views of the drawer unit in the image forming apparatus according to Embodiment 2 of the present invention. The FIG. 24 and FIG. 25 are the perspective views, as seen from the different directions.

The drawer unit U2 according to this embodiment is different from Embodiment 1 in that the drawer member 63 is provided with the positioning portions 63*a*, 63*b* in order to position the developing cartridge 60 in the drawer member 63.

The developing cartridge 60 is positioned in the drawer member 63 by the portions to be positioned 61*b* and 62*b* (FIG. 22) engaging with the positioning portions 63*a*, 63*b* provided in the drawer member 63.

Similarly to Embodiment 1, the drawer member 63 is provided with the contacting and spacing member 42. Since the structure of the contacting and spacing member 42 is similar to Embodiment 1, the description is omitted for the sake of simplicity. In addition, similarly to Embodiment 1, the drawer unit U2 comprises the drawer member 63 and the contacting and spacing member 42.

<Mounting of Photosensitive Member Cartridge and Developing Cartridge to Drawer Member>

Referring to FIGS. 26 and 27 the description will be made as to the mounting of the developing cartridge s 60 (60*y*, 60*m*, 60*c*, 60*k*) and the photosensitive member cartridges 50 (50*y*, 50*m*, 50*c*, 50*k*) to the drawer member 63. The FIGS. 26 and 27 are the perspective views illustrating the state of mounting the photosensitive member cartridge and the developing cartridge according to Embodiment 2 of the present invention to the drawer member. The FIGS. 26 and 27 illustrate the state of the process of the mounting of the cartridge and are views, as seen from the different directions.

In this embodiment, the photosensitive member cartridge 50 and the developing cartridge 60 are mounted individually into the drawer member 63. In the case of mounting them to the drawer member 63, the photosensitive member cartridge 50 is mounted, and thereafter the developing cartridge 60 is mounted.

In the case of mounting the photosensitive member cartridge 50, it is mounted by the user while the portions-to-be-guided 31*a*, 31*b* provided at the opposite ends of the photosensitive member cartridge 50 are guided to the guide portions 63*c*, 63*d* of the drawer member 63. Then, it is mounted while the portions-to-be-guided 31*c*, 31*d* are guided by the guide portions 63*e*, 63*f*. By this, the photosensitive member cartridge 50 is mounted to the inside of the drawer member 63.

In the case of mounting the developing cartridge 60, the user mounts the developing cartridge 60, so that the portions to be positioned 61*b*, 62*b* of the developing cartridge 60 aligns with the positioning portions 63*a*, 63*b* provided in the drawer member 63. However, the portions to be positioned 61*b*, 62*b* are not contacted to the positioning portions 63*a*, 63*b* at the time mounting.

In the process in which the photosensitive member cartridge 50 is mounted to the drawer member 63, the force receiving portion 31*e* provided on the photosensitive member cartridge 50 contacts to the first projection (force applying portion) 42*b* (FIG. 26) provided on the contacting and spacing member 42. The force receiving portion 61*a* provided on the side cover 71 of the developing cartridge 60 contacts to the second projection (force applying portion) 42*c* (FIG. 26).

By the force receiving portion 31*e* provided on the photosensitive member cartridge 50 contacting to the first projection 42*b*, the photosensitive member cartridge 50 is held at the position higher than the image forming position. That is, the surface of the photosensitive drum 1 is held at the position (spaced position) higher than the surface (recording material conveying surface 11*a*) of the transfer belt 11.

By the force receiving portion 61*a* provided on the developing cartridge 60 contacting to the second projection 42*c* provided on the contacting and spacing member 42, the surface of the developing roller 40 is spaced from the surface of the photosensitive drum 1. As to this, the description will be made referring to FIG. 28. FIG. 28 is a schematic sectional view illustrating the state that the drawer unit according to Embodiment 2 of the present invention is mounted into the main assembly. In FIG. 28, a schematic sectional view of the whole device and a schematic enlarged cross-sectional view of a photosensitive drum neighborhood are shown.

The second projection 42*c* provided on the contacting and spacing member 42 is disposed at the position higher than the first projection 42*b*. On the other hand, the force receiving portion 31*e* provided in the photosensitive member cartridge 50 and the force receiving portion 61*a* provided in the developing cartridge 60 are substantially at the same heights in the state of not receiving the external force. By this, the developing cartridge 60 is held at the position higher than the photosensitive member cartridge 50. Therefore, the surface of the developing roller 40 is separated from the surface of the photosensitive drum 1.

Here, the contacting and spacing member 42 is provided only at the one-end portion of the drawer member 63. The force receiving portion 61*a* for receiving the force from the second projection 42*c* of the contacting and spacing member 42 is also provided only on the one side of the developing cartridge 60. However, since the portion to be positioned, 62*b* provided at the other end portion of the developing cartridge, 60 is outwardly provided beyond the end with respect to the longitudinal direction of the photosensitive drum 1, the surface of the developing roller 40, can be separated from the surface of the photosensitive drum 1. That is, the force receiving portion 61*a* receives the force from the second projection 42*c*, so that the developing cartridge 60 rises at the one-end portion. On the other hand, in the other end portion, the portion to be positioned 62*b* is in contact to a positioning portion 63*b* of the drawer member 63. For this reason, the developing cartridge 60 is oblique relative to the photosensitive drum 1. However, as has been described hereinbefore, since the portion to be positioned 62*b* is outwardly provided beyond the longitudinal end of the photosensitive drum 1, the surface of the developing roller 40 is spaced from the surface of the photosensitive drum 1.

In this manner, when the photosensitive member cartridge 50 and the developing cartridge 60 are mounted, the contacting and spacing member 42 is in such a position that the first projection 42*b* contacts to the force receiving portion 31*e*, and the second projection 42*c* contacts to the force receiving portion 61*a*. At this time, the surface of the photosensitive drum 1 can be placed in the position spaced from the surface of the transfer belt 11. The surface of the developing roller 40 can be placed in the position spaced from the surface of the photosensitive drum 1. Similarly to Embodiment 1, such a position that the contacting and spacing member 42 spaces the developing roller 40 from the photosensitive drum 1, is a spacing position.

In this manner, in the process in which the developing cartridge 60 is mounted to the drawer member 63, in the state that the surface of the developing roller 40 is spaced from the surface of the photosensitive drum 1, the developing cartridge 60 is mounted. Therefore, in mounting the developing cartridge 60 to the drawer member 63 the surface damage due to the rubbing between the surface of the photosensitive drum 1 and the surface of the developing roller 40 by the impact at the time of the mounting can be suppressed.

As has been described in the foregoing, the photosensitive member cartridge 50 and the developing cartridge 60 are mounted to the drawer member 63 while spacing is established between the surface of the developing roller 40 and the surface of the photosensitive drum 1 and between the surface of the photosensitive drum 1 and the surface of the transfer belt 11.

<Mounting of Drawer Unit into Main Assembly>

Referring to FIG. 29-FIG. 31, the description will be made as to the mounting operation of the drawer unit U2 into the main assembly. FIG. 29 is a schematic sectional view illustrating the state that the drawer unit according to Embodiment 2 of the present invention is mounted to the inside of the main assembly. FIG. 30 is a schematic sectional view illustrating the state which the drawer unit according to Embodiment 2 of the present invention is mounted to the inside of the main assembly, and the door opens. FIGS. 29 and 30 include a schematic sectional view of the whole device and a schematic enlarged cross-sectional view of the neighborhood of one photosensitive drum are shown. FIG. 31 is a schematic sectional view illustrating the state that the drawer unit according to Embodiment 2 of the present invention is mounted to the inside of the main assembly, and the door closes. In FIG. 31, the image forming operation is not carried out.

As shown in FIG. 29, the drawer unit U2 (drawer member 63) is mounted to the inside of the main assembly in a direction of the arrow D1. During the mounting operation of the drawer unit U2, the surface of the photosensitive drum 1 and the recording material conveying surface 11*a* of the transfer belt 11 are spaced from each other. That is, a gap g is provided between the surface of the photosensitive drum 1 and the recording material conveying surface 11*a* of the transfer belt 11. Therefore, the drawer unit U2 can be mounted to the inside of the main assembly without the surface of the photosensitive drum 1 rubbing with the surface of the transfer belt 11.

During the mounting operation of the drawer unit U2, the contacting and spacing member 42 is placed in the spacing position, and the surfaces of the photosensitive drum 1 and the developing roller 40 is also spaced from each other. That is, the gap h is provided therebetween. Therefore, in mounting the drawer unit U2 to the inside of the main assembly, the damage due to the contact between the surface of the photosensitive drum 1 and the surface of the developing roller 40 by the impact at the time of the mounting and so on can be suppressed.

As shown in FIG. 30, in the state that the drawer unit U2 is completely inserted into the main assembly, and the door 10 is open, the surface of the photosensitive drum 1 and the recording material conveying surface 11*a* of the transfer belt 11 are still spaced from each other. The surfaces of the photosensitive drum 1 and the developing roller 40 are also spaced from each other.

FIG. 31 shows the state where the door is closed, even if the door 10 is in the closed state, when the image forming operation is not carried out, the space is kept between the surface of the photosensitive drum 1 and the recording material conveying surface 11*a* of the transfer belt 11 and between the surface of the photosensitive drum 1 and the surface of the developing roller 40 That is, the contacting and spacing member 42 is placed in the spacing position.

In the state as described above, the device waits for the instruction of the image forming operation from the main assembly.

<Operation of Each Part at the Time of Image Forming Operation>

Referring to FIG. 32-FIG. 36, the description will be made as to the operation of each part at the time of the image forming operation. FIG. 32 is a perspective view illustrating the state immediately after the image formation instruction in the drawer unit according to Embodiment 2 of the present invention. FIG. 33 is a schematic sectional view illustrating the state in the course of the drawer unit according to Embodiment 2 of the present invention being mounted to the inside of the main assembly, and shifting to the image forming operation. FIG. 33 includes a schematic sectional view of the whole device and a schematic enlarged cross-sectional view of the neighborhood of the one photosensitive drum. FIG. 34 is a schematic sectional view illustrating the state in the course of shifting to the image forming operation in the image forming apparatus according to Embodiment 2 of the present invention. FIG. 35 is a schematic sectional view illustrating the state in the course of shifting to the image forming operation in the image forming apparatus according to Embodiment 2 of the present invention. FIG. 35 includes a schematic sectional view of the whole device and a schematic enlarged cross-sectional view of the neighborhood the one photosensitive drum. FIG. 36 is a schematic sectional view illustrating the state that the image forming operation is enabled in the image forming apparatus according to Embodiment 2 of the present invention. FIG. 36 includes a schematic sectional view of the whole device and a schematic enlarged cross-sectional view of the neighborhood of the one photosensitive drum.

When the instruction of the image formation is produced, the driving gear 46 connected operatively with the motor (unshown) provided in the main assembly rotate in the direction of arrow F as shown in FIG. 32. Therefore, by the rack portion 42*a* in engagement with the driving gear 46, the contacting and spacing member 42 is moved in the direction of arrow G in the Figure. When the contacting and spacing member 42 moves to the position shown in FIG. 32, the force receiving portion 31*e* provided on the photosensitive member cartridge 50 separates from the first projection 42*b* of the contacting and spacing member 42. However, the force receiving portion 61*a* provided on the developing cartridge 60 is still placed on the second projection 42*c*. Such a mechanism is established because the second projection 42*c* is longer than the first projection 42*b* with respect to the movement direction of the contacting and spacing member 42.

FIG. 33 shows a schematic sectional view of the entirety of the device in the state of FIG. 32. As has been described hereinbefore, the force receiving portion 31*e* separates from the first projection 42*b* by the moving operation of a contacting and spacing member 52, by which the surface of the photosensitive drum 1 is contacted to the surface of the transfer belt 11. On the other hand, the force receiving portion 61*a* is still in the state of keeping receiving the force from the second projection 42*c*, and therefore, the developing roller 40 is spaced from the surface of the photosensitive drum 1. The surface of the photosensitive drum 1 and the surface of the developing roller 40 are spaced from each other, and position of the contacting and spacing member 42 is a spacing position.

As shown in FIG. 34, thereafter, the urging members 65, 66 provided in the main assembly side are driven by the unshown driving source to move in the direction of arrow H. The urging members 65, 66 contact to the force receiving portions 31*e* and 31*f* (FIG. 23) provided on the photosensitive member cartridge 50 to apply a force thereto. By this, the portion-to-be-guided 31*a* (FIG. 23) of the photosensitive member cartridge 50 contacts to a positioning portion 63*c*1 (FIG. 25) provided in the drawer member 63. The portion-to-be-guided 31*b* (FIG. 23) contacts to the positioning portions 63*d*1 (FIG. 24). Furthermore, the portions-to-be-guided 31*c* and 31*d* (FIG. 23) fitting with the guide portions 63*e* and 63*f* (FIGS. 24, 25), and, and the photosensitive member cartridge 50 is positioned in the drawer member 63.

As has been described in the foregoing, by the function of the urging members 65, 66, the photosensitive member cartridge 50 is positioned in the main assembly.

Thereafter, in order to contact the developing roller 40 to the photosensitive drum 1, the driving gear 46 further rotates, and the contacting and spacing member 42 is further moved to the direction of arrow G (FIG. 32). By this, the force receiving portion 61*a* provided in the developing cartridge 60 separates from the second projection 42*c* of the contacting and spacing member 42 and does not receive the force from a second projection 42C. By this, the developing cartridge, 60 is moves downwardly with respect to the vertical direction by the weight thereof, so that the surface of the developing roller 40 and the surface of the photosensitive drum 1, contact to each other. At this time, the portions to be positioned 61*b* and 62*b* (FIG. 22) of the developing cartridge 60 and the positioning portions 63*a* and 63*b* (FIGS. 24, 25) provided in the drawer member 63 are not in contact yet to each other. FIG. 35 is a schematic sectional view illustrating the state at that time. In this state, as has been described hereinbefore, the surface of the developing roller 40 and the surface of the photosensitive drum 1 contact to each other. The position in which the contacting and spacing member 42 contacts the developing roller 40 to the photosensitive drum 1 is a contacting position.

As shown in FIG. 36, thereafter, an urging member 67 provided in the main assembly is driven by the unshown driving source to move in a direction of arrow J. The urging members 67 are provided on the both side surfaces of the main assembly, and four pairs thereof are provided correspondingly to the developing cartridge 60.

The pair of urging members 67 abut to the force receiving portions 61*a* and 62*a* (FIG. 22) provided on the developing cartridge 60 to apply a force. By this, the portions to be positioned 61*b* and 62*b* (FIG. 22) of the developing cartridge 60 is pressed toward the positioning portions 63*a* and 63*b* (FIGS. 24, 25) provided in the drawer member 63. The surface of the developing roller 40 is pressed toward the surface of the photosensitive drum 1 as the fulcrum in the portions to be positioned 61*b*, 62*b*. The surface of the photosensitive drum 2 enters into the surface of the developing roller 40, and at the time of the amount of entrances reaches the predetermined level, the portions to be positioned 61*b*, 62*b* of the developing cartridge 60 and the positioning portions 63*a*, 63*b* provided on the drawer member 63 contact to each other.

As has been described in the foregoing, the developing cartridge 60 is positioned in the main assembly by the urging member 67.

When the positioning of the developing cartridge 60 is completed, the image formation is enabled in the image forming apparatus 100. In this state, the contacting and spacing member 42 is placed in a contacting position, wherein the developing roller 40 can be contacted to the photosensitive drum 1. As for the image forming operation, the description in Embodiment 1 applies.

When the image formation finishes, the urging member 67 is moved in the opposite direction (opposite direction to arrow J in FIG. 36) to the above-described pressing direction with the unshown driving source. The driving gear 46 is rotated in the direction of arrow F shown in FIG. 32 is the opposite direction, and the contacting and spacing member 42 is moved in the direction of arrow I in FIG. 32. By this, the contacting and spacing member 42 is moved to the spacing position, and the surface of the developing roller 40 is spaced from the surface of the photosensitive drum 1 (FIG. 34).

Thereafter, the urging members 65, 66 move in the opposite direction to the above-described pressing direction, and the contacting and spacing member 42 further moves in the direction of arrow I. By this, the surface of the photosensitive drum 1 is spaced from the surface of the transfer belt 11 (FIG. 31). In this state, the device waits for the instruction of the next image formation. Or, in the case of drawing the drawer member 63, the spacing is maintained between the surface of the photosensitive drum 1 and the surface (recording material conveying surface 11*a*) of the transfer belt 11, and between the surface of the photosensitive drum 1 and the surface of the developing roller 40. That is, the contacting and spacing member 42 is placed in the spacing position. Therefore, in drawing the drawer member 63 to the outside of the main assembly the damage due to the contact between the surface of the photosensitive drum 1 and the surface of the developing roller 40 by the impact at the time of the movement and so on can be suppressed. Furthermore, since this spacing can be maintained the rubbing between these surfaces can be prevented.

As has been described in the foregoing, according to the image forming apparatus 100 of this embodiment, the contacting and spacing member is movable between the spacing position and the contacting position And, by the movement of the contact member 42, the developing roller 40 moves timely to the position of spacing from the photosensitive drum 1 or the position of contacting to the photosensitive drum 1. By this, the state of the developing roller 40 not contacting to the photosensitive drum 1 can be established, when the image forming operation is not carried out, namely, during drawing the drawing unit U1 (drawer member 13) outwardly, and so on. Therefore, the deteriorations of various members can be suppressed, and the service lives can be extended.

In addition, the image forming apparatus 100 according to this embodiment employs a structure in which the drawer member 13 is provided with the contacting and spacing member 42. Therefore, the structure for advancing the contacting and spacing member from the main assembly side of the apparatus into the drawer member is not necessitated unlike in the conventional example in which the contacting and spacing member for spacing the developing roller from the photosensitive drum is provided in the main assembly side of the apparatus. In other words, no space is required to move the contacting and spacing member from the main assembly side of the apparatus to the position of the cartridge in the drawer member, and therefore, the main assembly of the apparatus can be downsized.

It would be considered that the contacting and spacing member is fixed to the main assembly side of the apparatus, and a force receiving portion of the drawer member provided in the cartridge receives a force from the contacting and spacing member by a pushing-in operation and a drawing operation to contact and space the developing roller relative to the photosensitive drum.

However, even when such a structure is employed, it is necessary to project the force receiving portion out of the drawer member in order to make the force receiving portion of the cartridge contactable to the contacting and spacing member. Therefore, the apparatus is not downsized enough. According to this embodiment, however, the contacting and spacing member 42 is provided in the drawer member 63, and therefore, it is unnecessary to project the force receiving portion 71*b* too much, and the developing cartridge 63 can be downsized.

Even when such structures are employed, the cartridge has to be mounted in the state that the force receiving portion of the cartridge is retracted from the contacting and spacing member, in order to contact the force receiving portion of the cartridge to the contacting and spacing member at the desired timing. And, the result is that the structure or mechanism is required to move the entire drawer member to the position where the force receiving portion of the cartridge contacts to the contacting and spacing member. According to this embodiment, however, the contacting and spacing member 42 is provided in the drawer member 13, and therefore, the structure of the main assembly of the apparatus can be simplified and downsized.

In the example of the transfer belt 11 in this embodiment, the transfer belt 11 feeds the sheet material S to the photosensitive drum 1 surface, and the developer image on the photosensitive drum 1 is directly transferred onto the sheet material S. However, the present invention is applicable to an image forming apparatus, wherein the developer image formed on the photosensitive drum is transferred, and finally it is re-transferred onto the recording material (sheet material) (intermediary transfer belt system).

In this embodiment, the contacting and spacing member 42 is provided only at the one-end portion of the drawer member 63. However, the contacting and spacing member maybe similarly provided also at the other end portion of the drawer member 63. However, in this case, it is preferable that the force receiving portion for receiving the force from the contacting and spacing member is also provided at the opposite ends. If the contacting and spacing members are provided on the respective sides, the shafts of the photosensitive drum and the developing roller of the photosensitive member cartridge and the developing cartridge do not incline during the movement of the cartridges. Therefore, the spacing state between the photosensitive drum and the transfer belt and the spaced state between the photosensitive drum and the developing roller can further be stabilized.

Embodiment 3

FIG. 37-FIG. 42 illustrates Embodiment 3 of the present invention.

In Embodiment 2, the photosensitive member unit (photosensitive member cartridge) and the developing unit (developing cartridge) are mounted individually to the drawer member. In this embodiment, the photosensitive member unit is fixed to the drawer member, and the developing unit (developing cartridge) is mounted to the drawer member. In Embodiments 1, 2, the contacting and spacing member moves in the moving direction of the drawer member. In this embodiment, the contacting and spacing member moves in a direction perpendicular to the moving direction of the drawer member. The fundamental structures except for the structures relating to the drawer member and the contacting and spacing member are the same as with the foregoing embodiments, and the description as to the common structures will be omitted when appropriate. The structural portions which are the same as with the foregoing embodiments are assigned, and the description therefor will be omitted.

<Mounting Portion for Drawing Unit (Drawer Member (Supporting Member))>

Mainly referring to FIG. 37, the mounting portion for the drawing unit (drawer member) will be described. FIG. 37 is a perspective view illustrating a mounting portion of the drawing unit in the main assembly of the apparatus of the image forming apparatus according to Embodiment 3 of the present invention. In FIG. 37, a scanner unit or the like of the members (parts) of the main assembly of the apparatus is omitted for better illustration of the structure of the mounting portion. Parts (a) and (b) in FIG. 37 are perspective views as seen in different directions.

On an internal wall surface of the main assembly frame of the apparatus, there are provided opposing guiding members 14RX, 14LX for guiding a moving direction of a drawing unit U3 which will be described hereinafter. The guiding members 14RX, 14LX are rail-like members each having a channel-like section for guiding a portion-to-be-guided 13*a*, 13*b*, 13*c*, 13*d* (FIG. 38) of the drawer member 63X which will be described hereinafter. The guiding members 14RX, 14LX extend substantially in the horizontal direction from a neighborhood of an entrance of the main assembly of the apparatus (neighborhood of door 10) to the rear side so as to guide the drawer member 63X from a position outside of the main assembly of the apparatus to a position accommodating it in the main assembly of the apparatus.

Above the guiding members 14RX, 14LX, there is provided urging members 65X, 66X for urging and positioning the developing cartridge 60X which is a developing unit which will be described hereinafter, in a predetermined position. Urging members 65X, 66X moves downwardly by a driving force from the main assembly side of the apparatus, so that the developing cartridge 60X is urged, and are provided in order to position the developing cartridge 60X to a predetermined position in the main assembly of the apparatus.

Below the guiding member 14LX, there are provided four developing device coupling members 26 for transmitting the drive to the developing cartridge 60X. The four developing device coupling members 26 are arranged horizontally at substantially regular intervals corresponding to the developing cartridges 60X at four positions. The developing device coupling member 26 transmits the driving force from an unshown driving source to the developing cartridge 60X. In the state that the door 10 is open, the developing device coupling member 26 is retracted inside the side wall as shown in (b) of FIG. 37, or in interrelation with closing of the door 10, it enters the developing cartridge 60X side.

<Drawing Unit>

Referring to FIGS. 38 and 39, the drawing unit U3 according to Embodiment 3 of the present invention will be described in detail. FIG. 38 is a perspective view of the drawing unit for the image forming apparatus of Embodiment 3 of the present invention. FIG. 39 is a schematic sectional view of the drawing unit for the image forming apparatus of Embodiment 3 of the present invention. In the four drawing units U3 of this embodiment, have fundamentally the same structures and are arranged in the drawing direction. Therefore, in FIGS. 38 and 39, only one fundamental structure is given reference numerals for simplicity of illustration.

In this embodiment, there is provided a drawer member 63X as a supporting member which is movable between an inside position which is inside the main assembly of the apparatus and in which it supports the photosensitive drum 1 and demountably supports the developing cartridges 60X and an outside position outside the main assembly of the apparatus. To the drawer member 63X, the photosensitive drum 1, the charging means 2, the cleaning means 6 and the residual toner container 30 or the like are fixed. In addition, a contacting and spacing unit 80 is provided on the drawer member 63X. Thus, the drawing unit U3 of this embodiment is constituted by the drawer member 63X, the photosensitive drum 1, the charging means 2, the cleaning means 6, the residual toner container 30, and the contacting and spacing unit 80 and so on.

Four corners of the drawer member 63X are provided with portions-to-be-guided 13*a*, 13*b*, 13*c*, 13*d* to be guided by the guiding members 14RX, 14LX of the main assembly of the apparatus. The portions-to-be-guided 13*a*, 13*c* are guided by the guiding members 14RX, and the portions-to-be-guided 13*b*, 13*d* are guided by the guiding members 14LX. The portions-to-be-guided 13*a*, 13*b* are projected outwardly from the lateral sides, and extends in the drawing direction so that the drawing unit U3 does not tilt in the drawing position. The portions-to-be-guided 13*c*, 13*d* are of circular column configuration and project outwardly of the lateral sides.

In the side wall of one of the drawer members 63X, an opening 13*l* for passing the developing device coupling member 26 is provided. The developing device coupling member 26 is constituted such that it enters the opening 13*l* in interrelation with the closing operation. The developing device coupling member 26 having passed through the opening 13*l* is brought into engagement with a coupling member 45X (FIG. 40) of the developing cartridge 60X. By this, the driving force is transmitted from an unshown driving source of the main assembly side of the apparatus to the developing cartridge 60X through the developing device coupling member 26 of the main assembly side of the apparatus and the coupling member 45X of the developing cartridge 60X.

The structure relating to positioning of the developing cartridge 60X relative to the drawer member 63X will be described.

The developing cartridge 60X is mounted to a position corresponding to the photosensitive drum 1 in the drawer member 63X. On each side of a region passed by the mounting developing cartridge 60X, there is provided a guide portion 13*q*, 13*r* for guiding the developing cartridge 60X into the drawer member 63X. Each guide portion 13*q*, 13*r* is provided with an elongated groove. A bottom portion of the groove of the guide portion 13*q* functions as a positioning portion for positioning the developing cartridge 60X. The opening 13*m* is provided adjacent to the lower end of the front side guide portion 13*q* in FIG. 38.

Inside the guide portion 13*r*, the contacting and spacing unit 80 is provided. The contacting and spacing unit 80 comprises a contacting and spacing member 81 supporting the developing cartridge 60X, and a spring 82 which is an urging member for urging the contacting and spacing member 81 upwardly. The contacting and spacing member 81 is movable between a contacting position for contacting the developing roller 40X to the photosensitive drum 1, and a spacing position for spacing the developing roller 40X from the photosensitive drum 1.

The contacting and spacing unit 80 of the embodiment is provided at each side of a mounting region of the developing cartridge 60X.

<Mounting of Developing Cartridge to Drawer Member>

Mainly referring to FIG. 40, the mounting of the developing cartridge 60X (60Xy, 60Xm, 60Xc, 60Xk) to the drawer member 63X will be described. The developing cartridges 60Xy, 60Xm, 60Xc, 60Xk may be referred to as developing cartridge 60X, without the last suffixes indicating the colors when appropriate. Here, y indicates yellow developer, m indicates magenta developer, c indicates cyan developer, and k indicates black developer.

FIG. 40 is a perspective view illustrating behavior in the mounting of the developing cartridge to the drawer member in the image forming apparatus of Embodiment 3 of the present invention. In mounting the developing cartridge, the drawer member 63X has-been drawn out of the main assembly of the apparatus, but in FIG. 40, the main assembly of the apparatus is omitted.

The developing cartridges 60X are mounted to the mounting portions, respectively, of the drawer member 63X. The user mounts the developing cartridge 60X in the direction of an arrow C which is substantially the direction of gravity.

Each of the side surfaces of the developing cartridge 60X is provided with a projection 61X. The projection 61X is guided by the guide portion 13*r* provided on the drawer member 63X. An outer periphery of a coupling member 45X provided on one of the side surfaces of the developing cartridge 60X is covered by a cylindrical rib. The cylindrical rib functions as a portion-to-be-guided to be guided by the guide portion 13*q* provided on the drawer member 63X. The other side surface of the developing cartridge 60X is provided with a portion-to-be-guided (unshown) to be guided by the guide portion 13*q* provided on the drawer member 63X.

When mounting the developing cartridge 60X, the portions-to-be-guided are first engaged with guide portions 13*q* of the drawer member 63X. Then, the projections 61X of the developing cartridge 60X are engaged with the guide portions 13*r* of the drawer member 63X.

In this manner, the developing cartridge 60X is mounted in the drawer member 63X by being guided by the guide portions 13*q*, 13*r*.

Here, the developing cartridge 60X is mounted to the drawer member 63X in the state that the projections 61X is placed on the contacting and spacing member 81. The contacting and spacing member 81 is urged upwardly by the spring 82 as described hereinbefore, so that the developing cartridge 60X is not mounted completely only by the weight of the developing cartridge 60X. In other words, the developing cartridge 60X is above a completely mounted position (capable of image forming operation), and the developing roller 40X is spaced from the photosensitive drum 1. The pair of portions-to-be-guided of the developing cartridge 60X are not contacted to the positioning portion (bottom portion of groove) in the guide portion 13*q* for positioning the developing cartridge 60X.

Therefore, the developing roller 40X does not contact the photosensitive drum 1 only by mounting the developing cartridge 60X to the drawer member 63X. Therefore, in the mounting operation of the developing cartridge 60X, the state that the surface of the developing roller 40X and the surface of the photosensitive drum 1 are spaced from each other can be maintained. Thus, the damage to the surface of the photosensitive drum 1 due to the mounting operation of the developing cartridge 60X can be suppressed. The position in which the developing roller 40X and the photosensitive drum 1 can be spaced from each other is called spacing position similarly to the foregoing embodiments.

<Positioning Structure for Developing Cartridge>

Mainly referring to FIGS. 41 and 42, the positioning structure for positioning the developing cartridge 60X in the main assembly of the apparatus will be described. FIG. 41 is a schematic sectional view illustrating a state in which the developing cartridge is mounted, and the image forming operation is not carried out in the image forming apparatus of Embodiment 3 according to the present invention. FIG. 42 is a schematic sectional view illustrating a state in which the positioning of the developing cartridge is completed (state capable of image formation) in the image forming apparatus of Embodiment 3 according to the present invention. In FIGS. 41 and 42, only the members of the members of the main assembly side of the apparatus which relate to the positioning of the developing cartridge.

When image formation instructions are produced, the developing roller 40X of the developing cartridge 60X is moved from the position (FIG. 41) spaced from the photosensitive drum 1 to the position contacting to the photosensitive drum 1 (FIG. 42). This enables image forming operation. The operations will be described.

The main assembly of the apparatus is provided with the pair of urging members 65X, 66X. The urging members 65X, 66X are driven by an unshown driving source to move downwardly in response to the image formation instructions (image formation signal). The urging members 65X, 66X downwardly urges the projections 61X of the both side surfaces of the developing cartridge 60X. By urging force, the pair of the projections 61X push down the contacting and spacing member 81 against the urging force of the spring 82. By this, the portions-to-be-guided of the developing cartridge 60X is moved downwardly along the guide portion 13*q* and are stopped by the positioning portion (bottom portion of groove).

In this manner, the developing cartridge 60X is positioned. In this state, the developing roller 40X contacts to the photosensitive drum 1 so that the image forming operation becomes possible (FIG. 42). The position in which the contacting and spacing member 81 is capable of contacting the surface of developing roller 40X to the surface of the photosensitive drum 1 is called contacting position.

In this manner, also in this embodiment, similarly to the foregoing embodiments, the contacting and spacing member 81 is positioned in the contacting position only when the image formation is carried out, and is positioned in the spacing position when the image forming operation is not carried out. By this, the state of the developing roller 40X not contacting to the photosensitive drum 1 can be established, when the image forming operation is not carried out, namely, during drawing the drawing unit U3 (drawer member 63 X) outwardly, and so on. Therefore, the deteriorations of various members can be suppressed, and the service lives can be extended.

Also in this embodiment, the contacting and spacing member 81 is provided in the drawer member 63X. Therefore, similarly to the cases of foregoing embodiments, the apparatus can be downsized.

INDUSTRIAL APPLICABILITY

Figure 1:
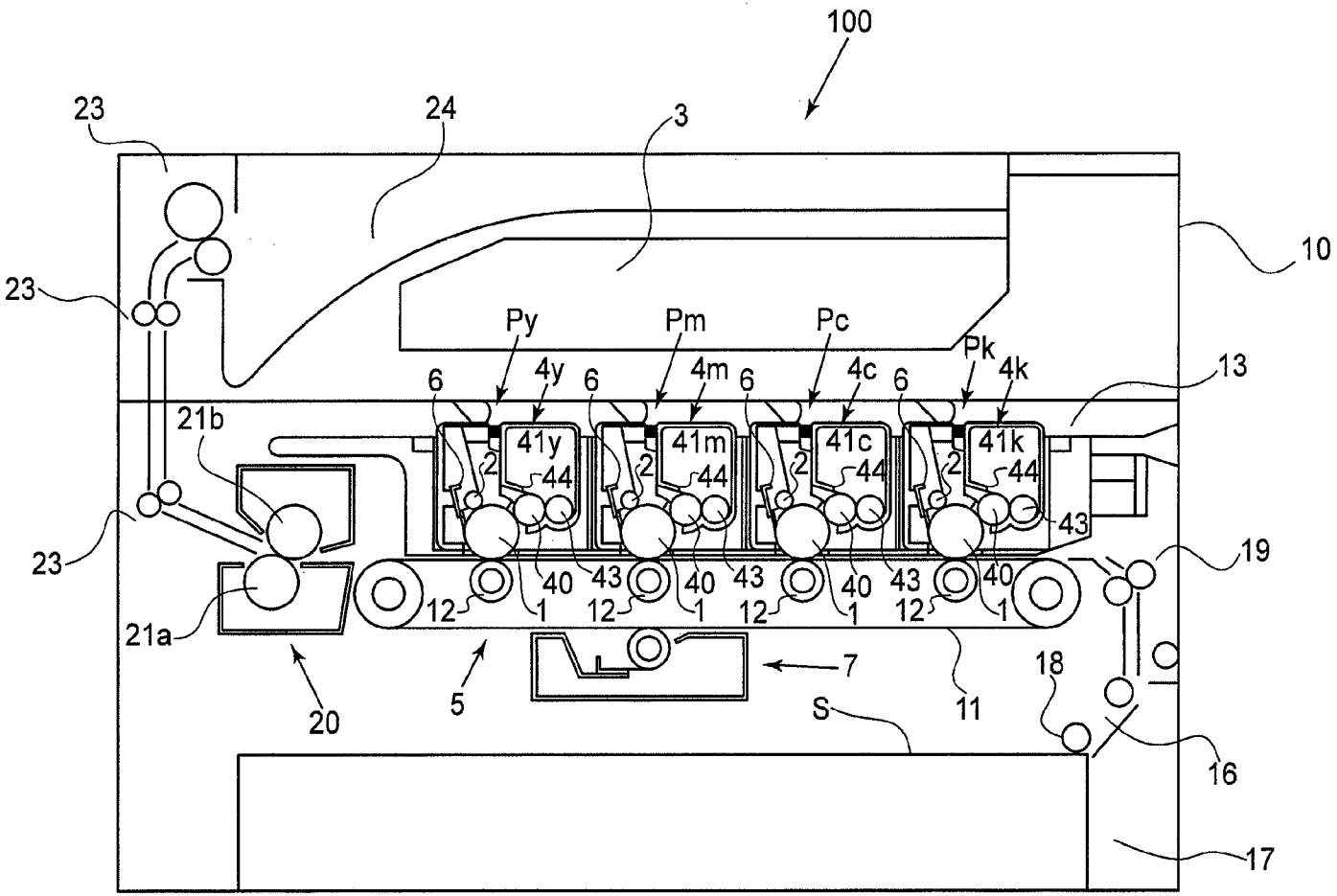
FIG. 1 is a schematic sectional view of a whole image forming apparatus according to Embodiment 1 of the present invention.
Figure 2:
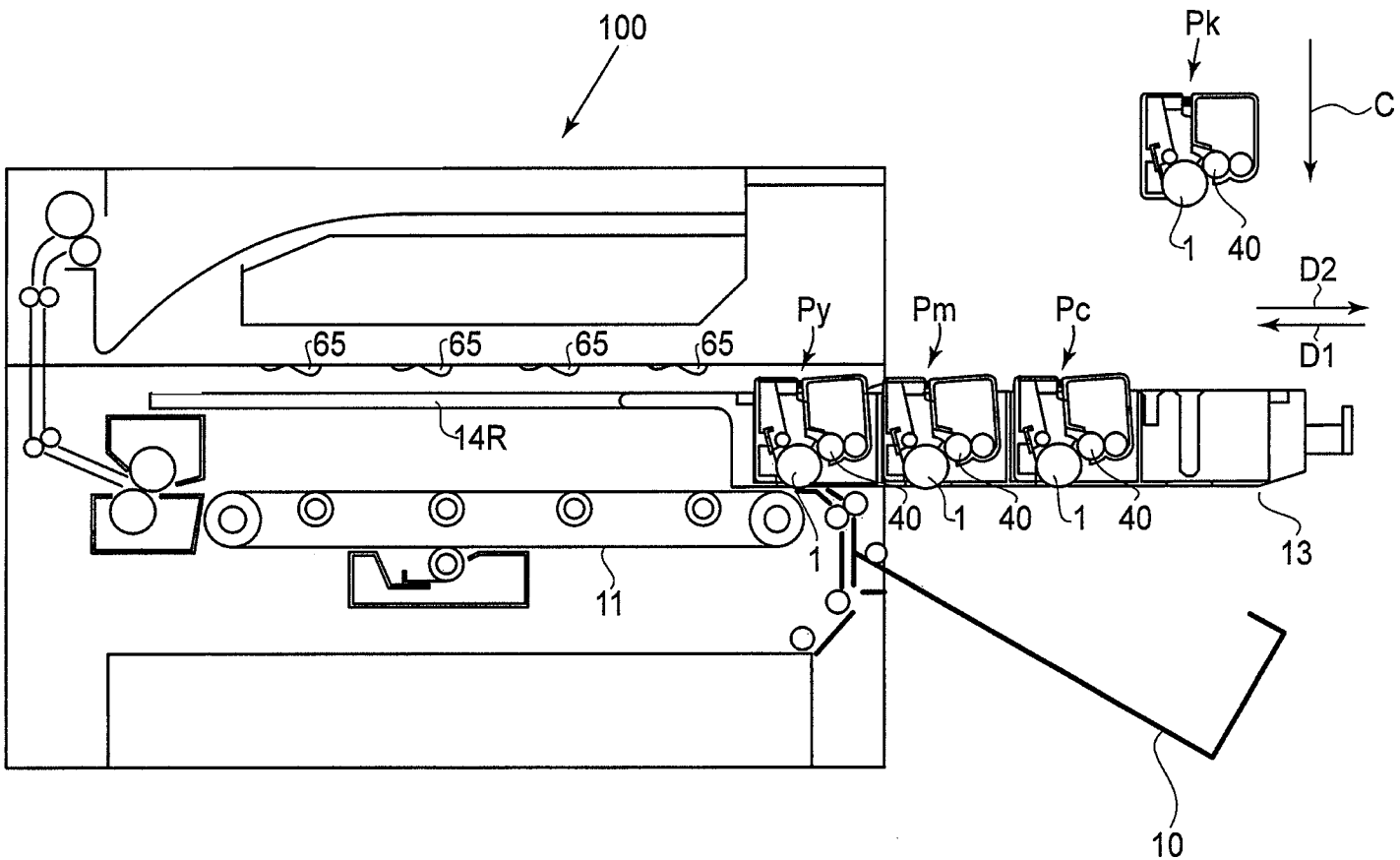
FIG. 2 is a schematic sectional view illustrating the state that a drawer unit in the image forming apparatus according to Embodiment 1 of the present invention is in an outside position.
Figure 3:
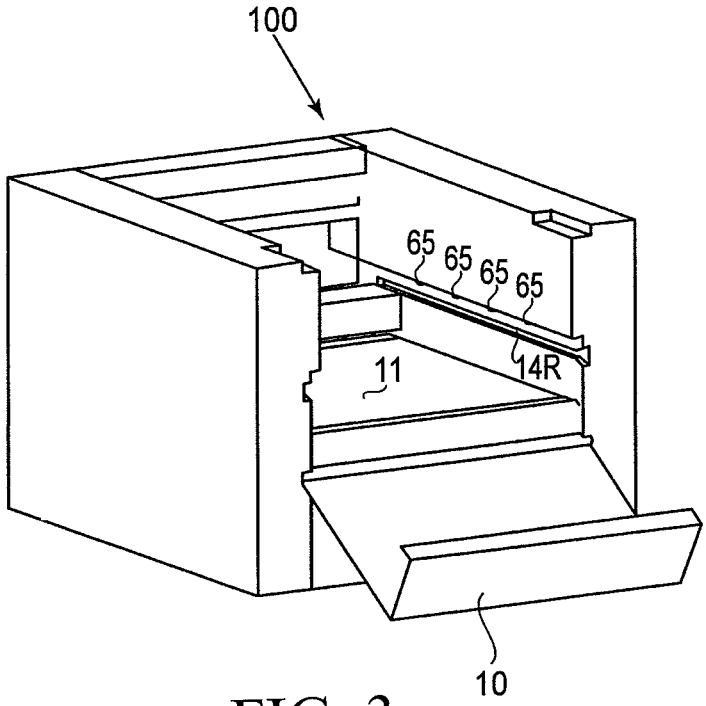
FIG. 3 is a perspective view illustrating a mounting portion for a drawer member in a main assembly of the image forming apparatus according to Embodiment 1 of the present invention.
Figure 4:
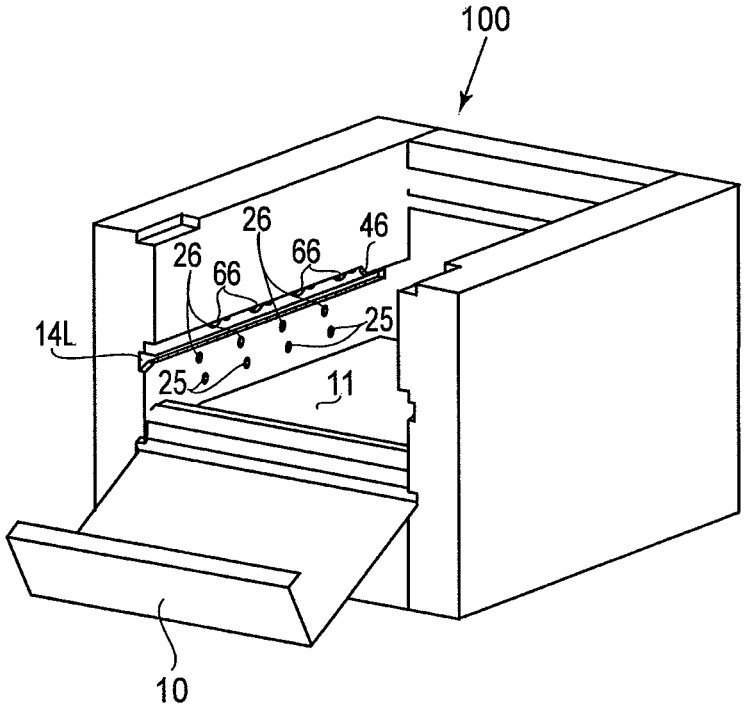
FIG. 4 is a perspective view illustrating the mounting portion for the drawer member in the main assembly of the image forming apparatus according to Embodiment 1 of the present invention.
Figure 5:
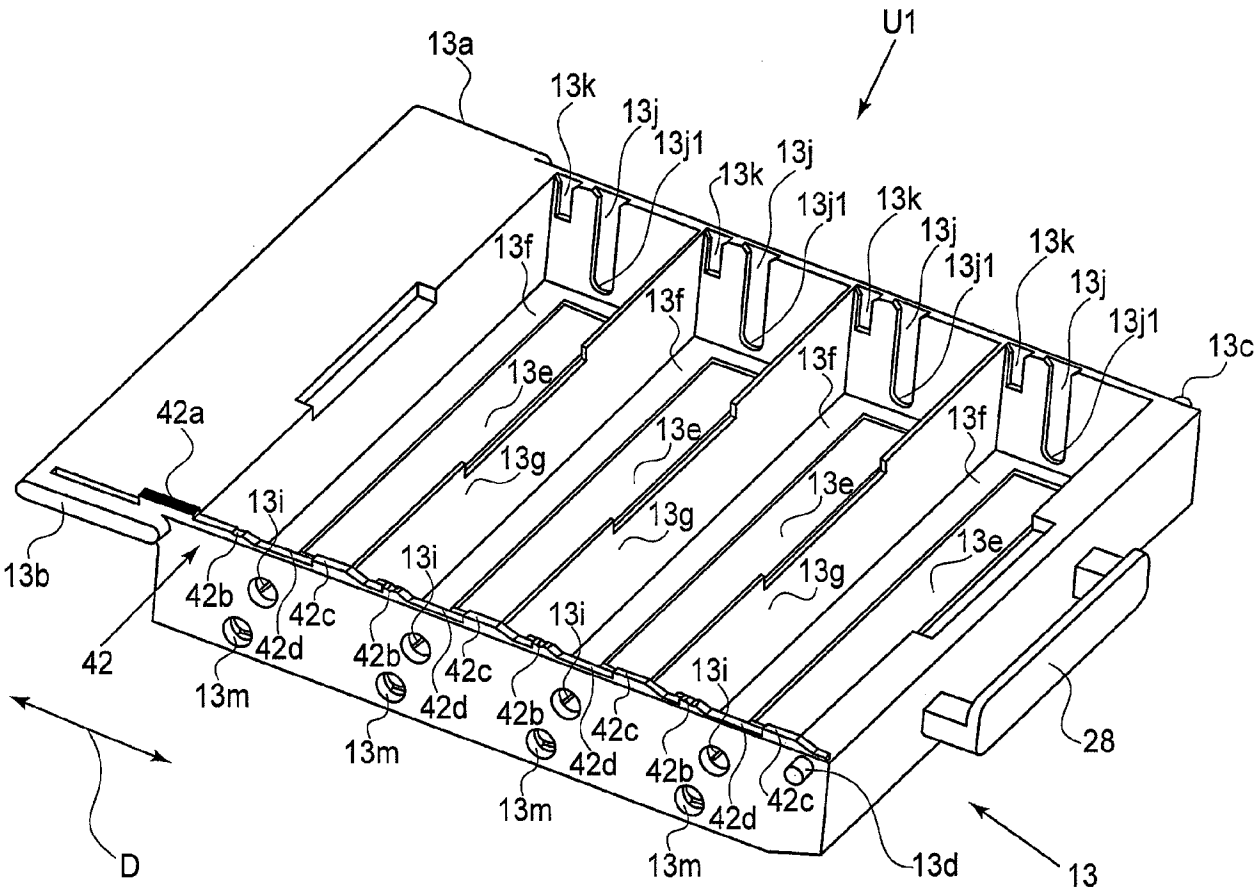
FIG. 5 is a perspective view of the drawer unit in the image forming apparatus according to Embodiment 1 of the present invention.
Figure 6:
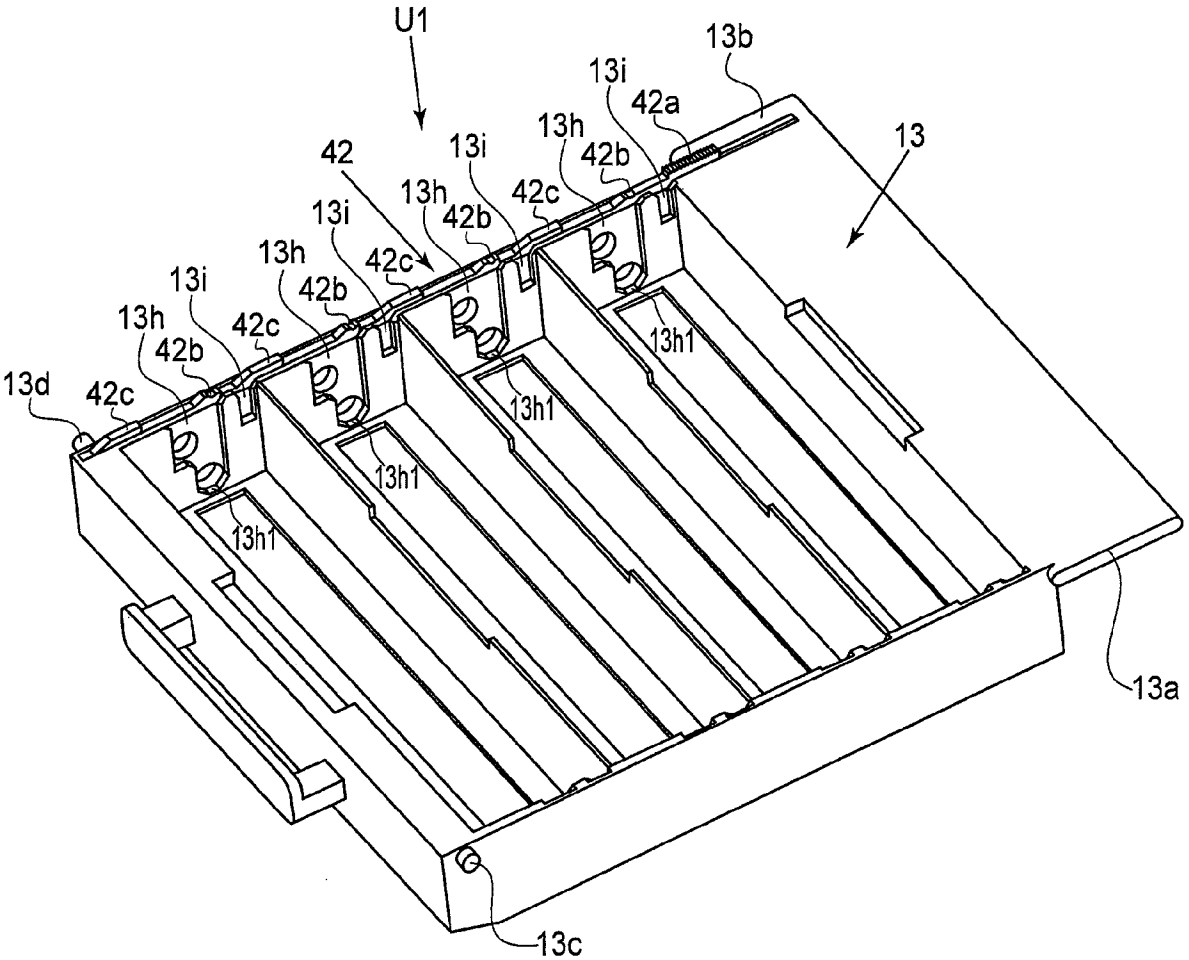
FIG. 6 is a perspective view of the drawer unit in the image forming apparatus according to Embodiment 1 of the present invention.
Figure 7:
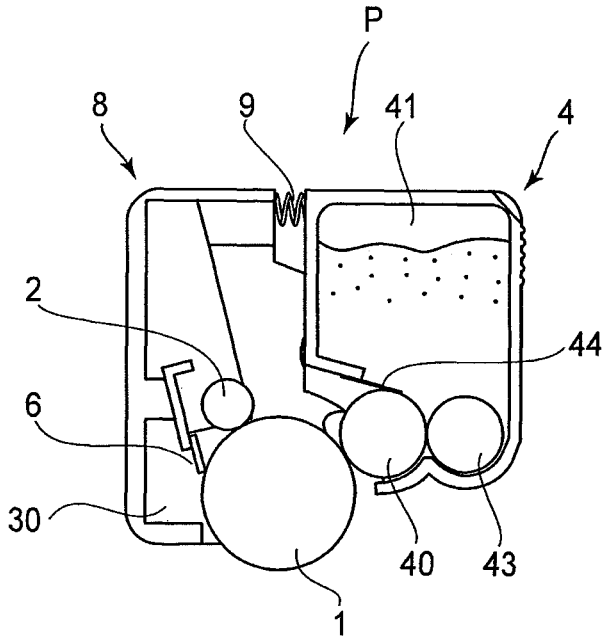
FIG. 7 is a schematic sectional view of a process cartridge according to Embodiment 1 of the present invention.
Figure 8:
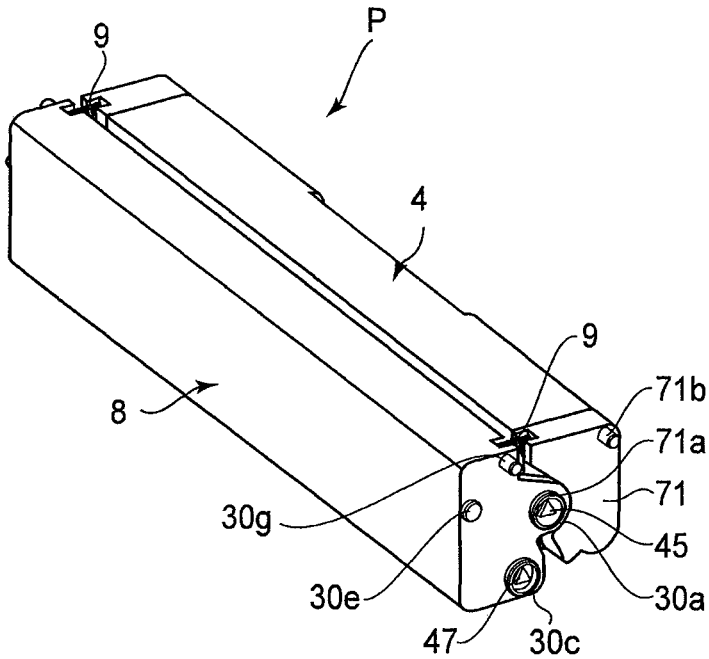
FIG. 8 is a perspective view of the process cartridge according to Embodiment 1 of the present invention.
Figure 9:
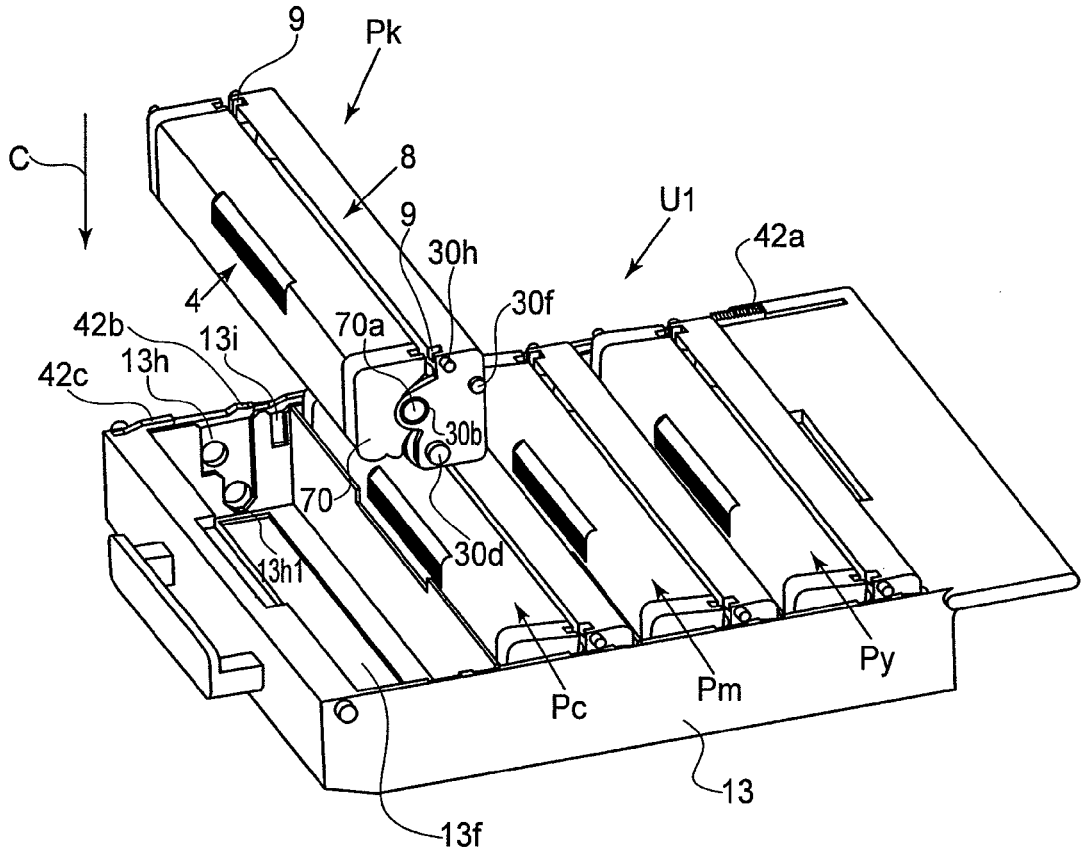
FIG. 9 is a perspective view illustrating a state that the process cartridge according to Embodiment 1 of the present invention is mounted to the drawer unit (drawer member).
Figure 10:
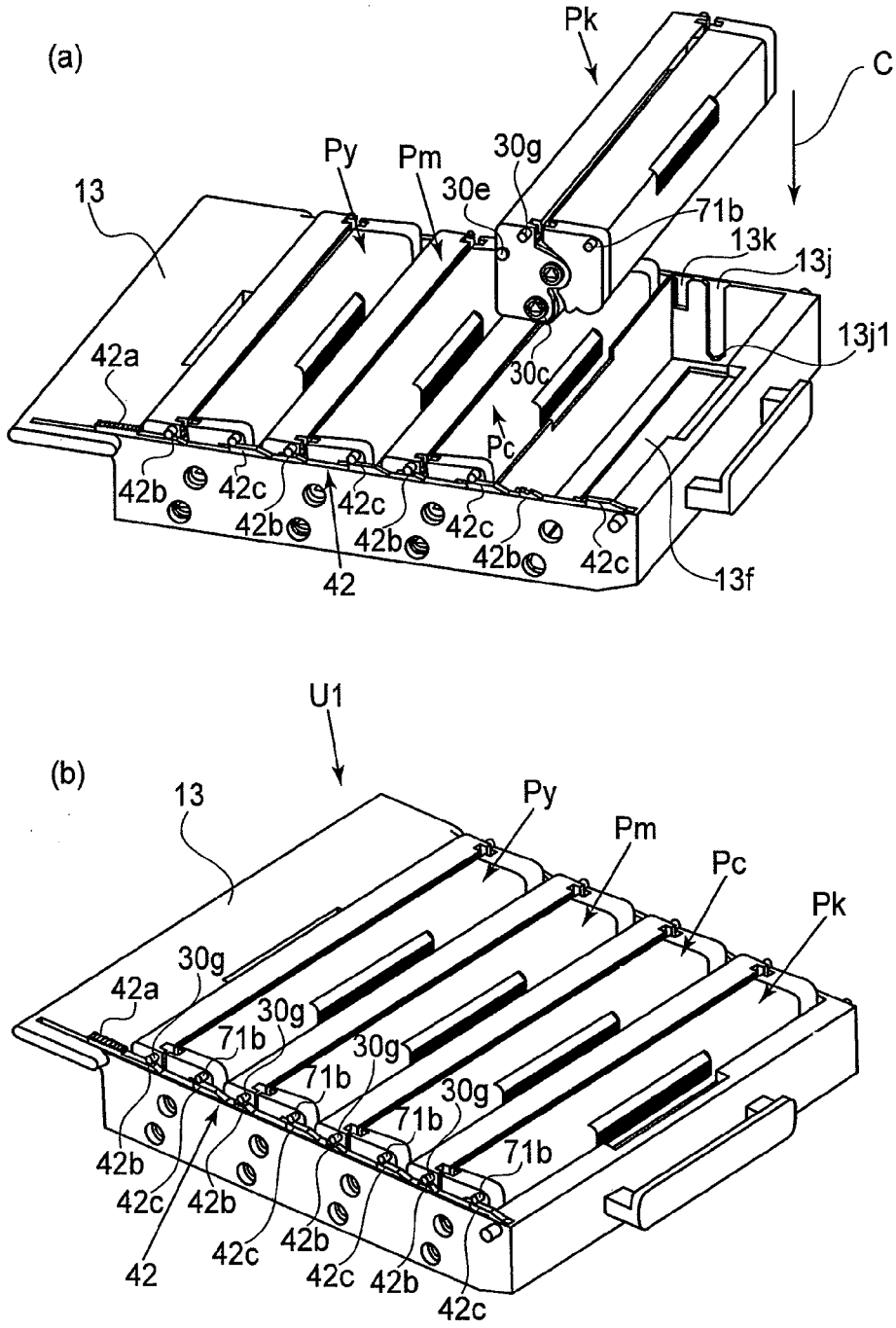
FIG. 10 is a perspective view illustrating the state that the process cartridge according to Embodiment 1 of the present invention is mounted to the drawer member.
Figure 11:
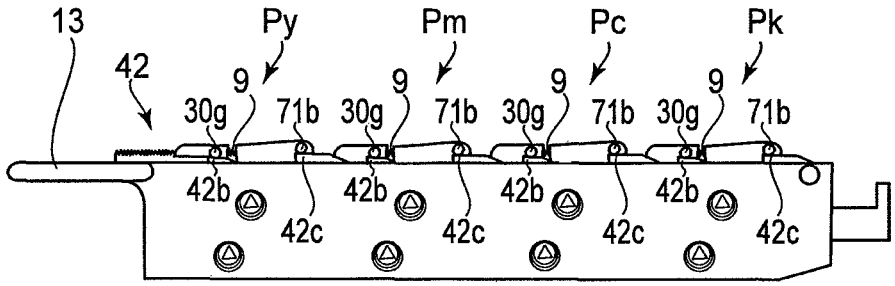
FIG. 11 is a schematic view showing the state that the process cartridge is mounted to the drawer member.
Figure 11:
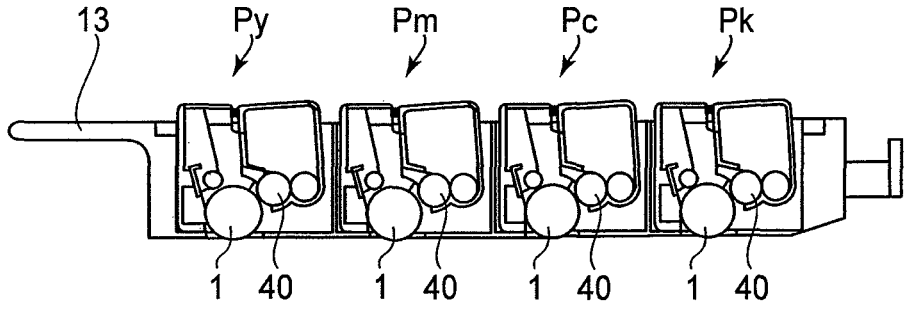
Figure 12:
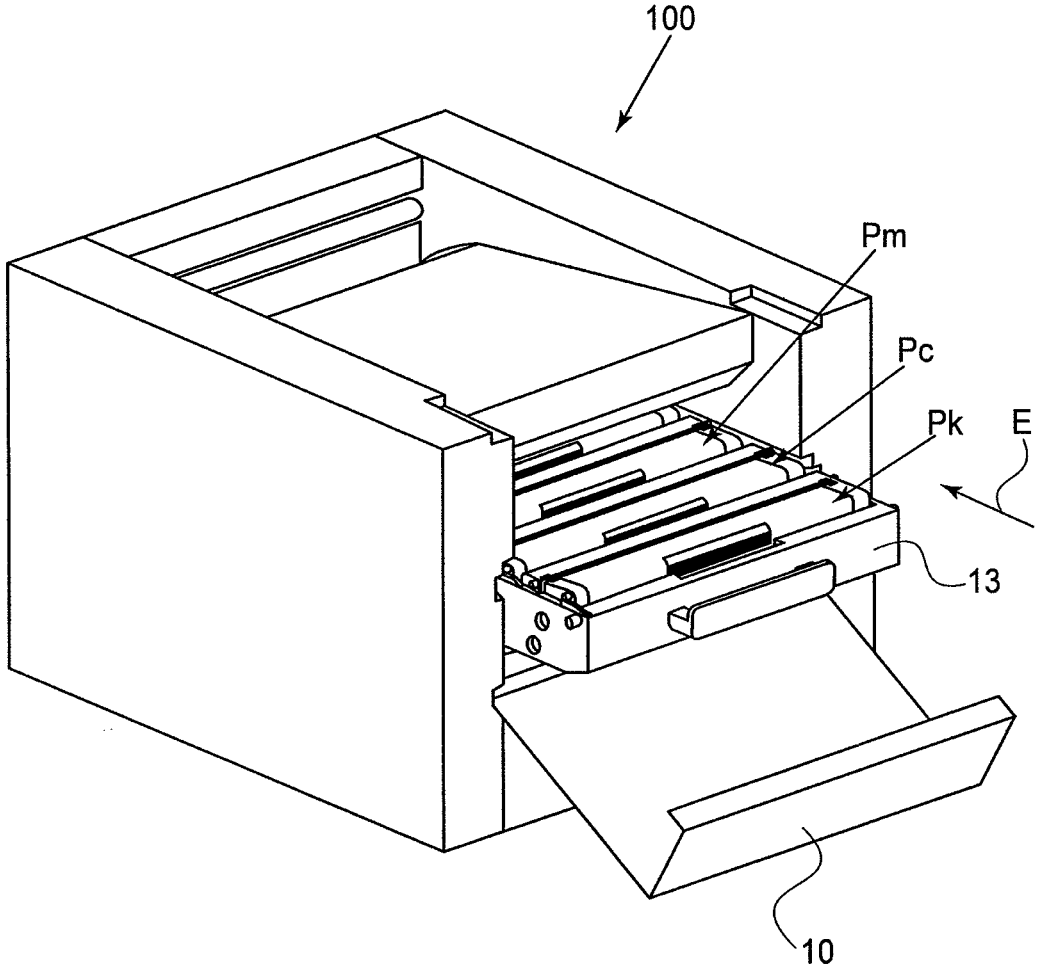
FIG. 12 is a perspective view illustrating the state that the drawer unit according to Embodiment 1 of the present invention is mounted into the main assembly.
Figure 13:
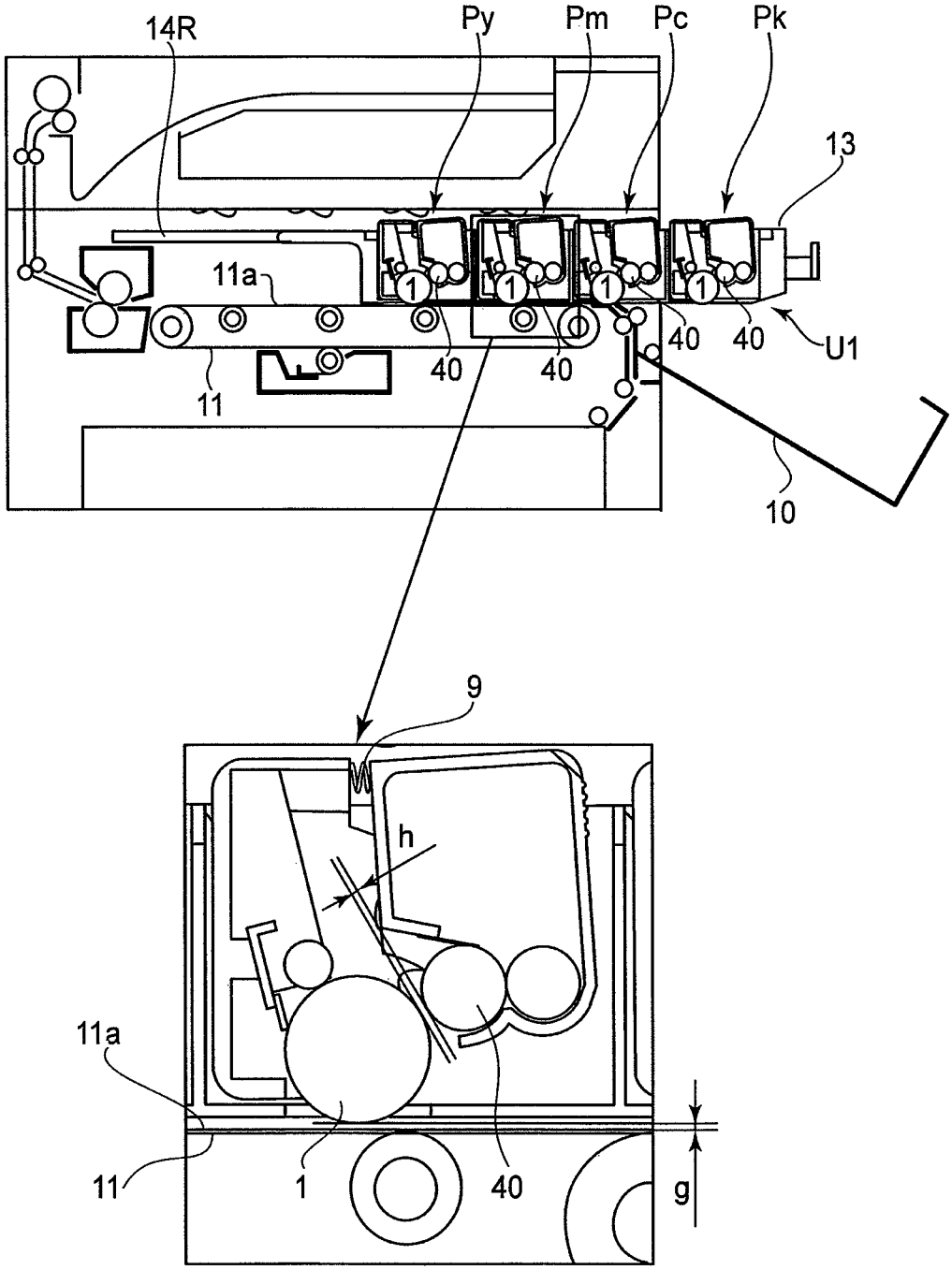
FIG. 13 is a schematic sectional view illustrating the state that the drawer unit according to Embodiment 1 of the present invention is mounted in the main assembly.
Figure 14:
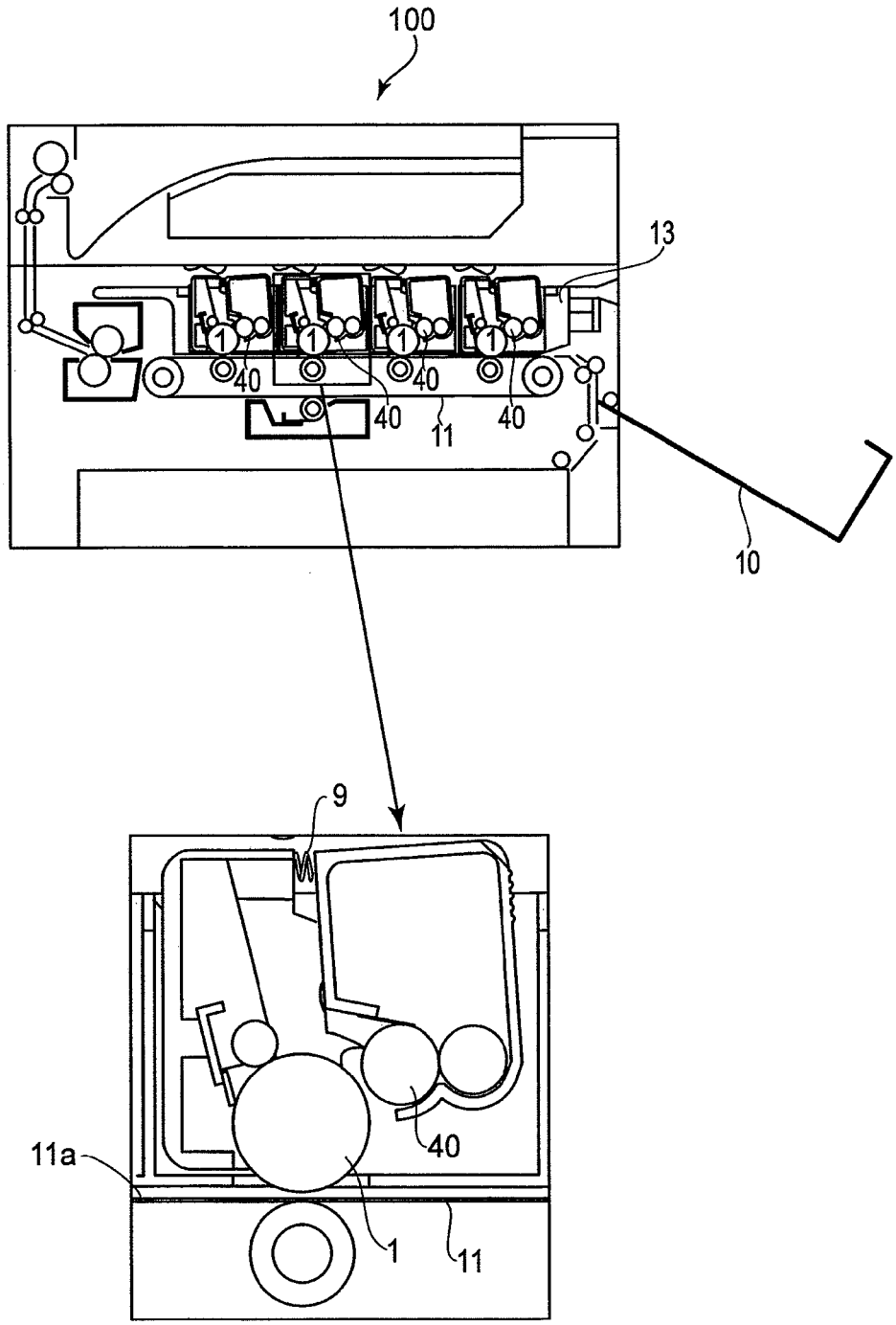
FIG. 14 is a schematic sectional view illustrating the state that the drawer unit according to Embodiment 1 of the present invention is mounted in the main assembly, and a door is open.
Figure 15:
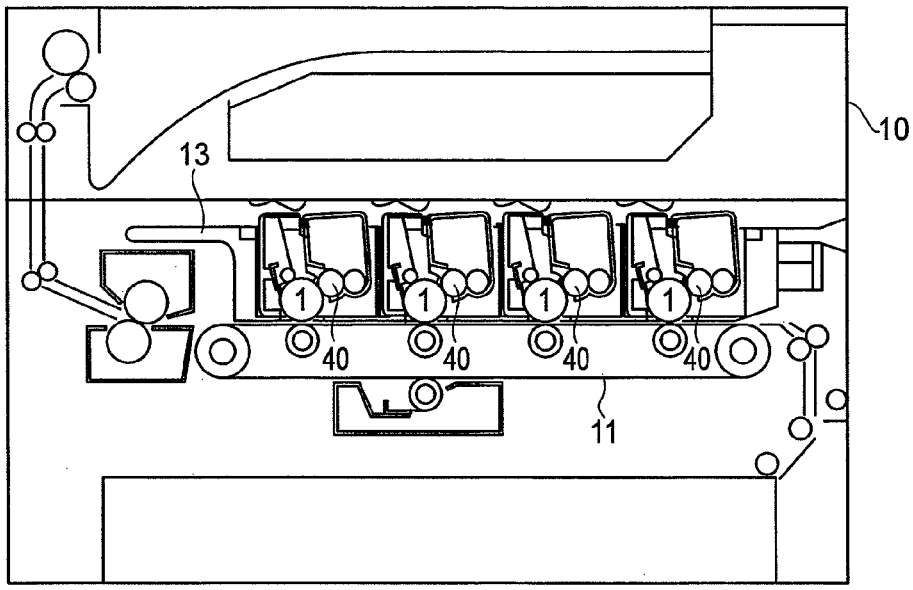
FIG. 15 is a schematic sectional view illustrating the state that the drawer unit according to Embodiment 1 of the present invention is mounted in the main assembly, and the door closes.
Figure 16:
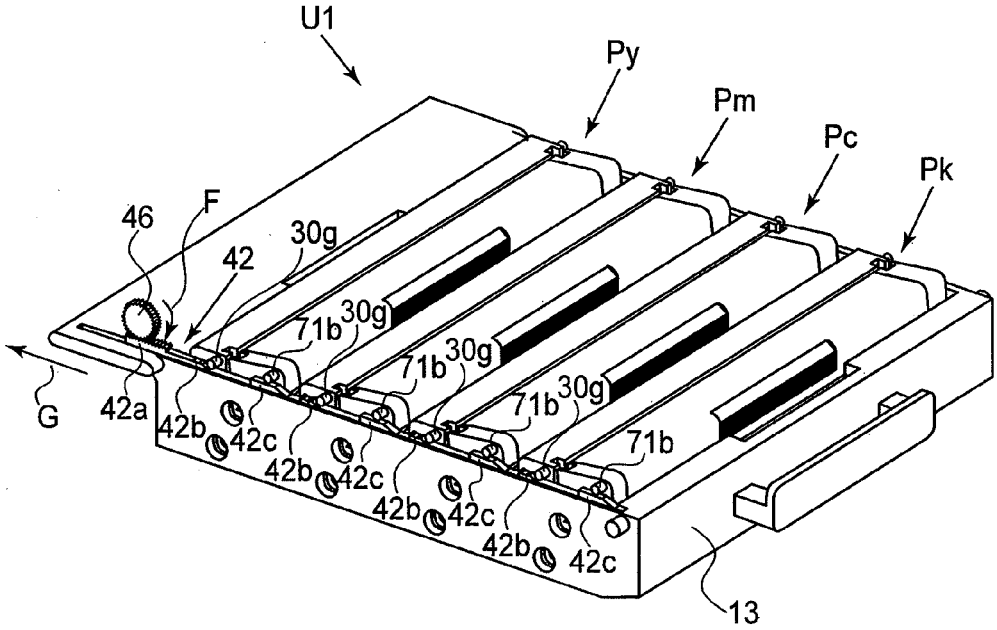
FIG. 16 is a perspective view illustrating the state immediately after the image formation instruction in the drawer unit according to Embodiment 1 of the present invention.
Figure 17:
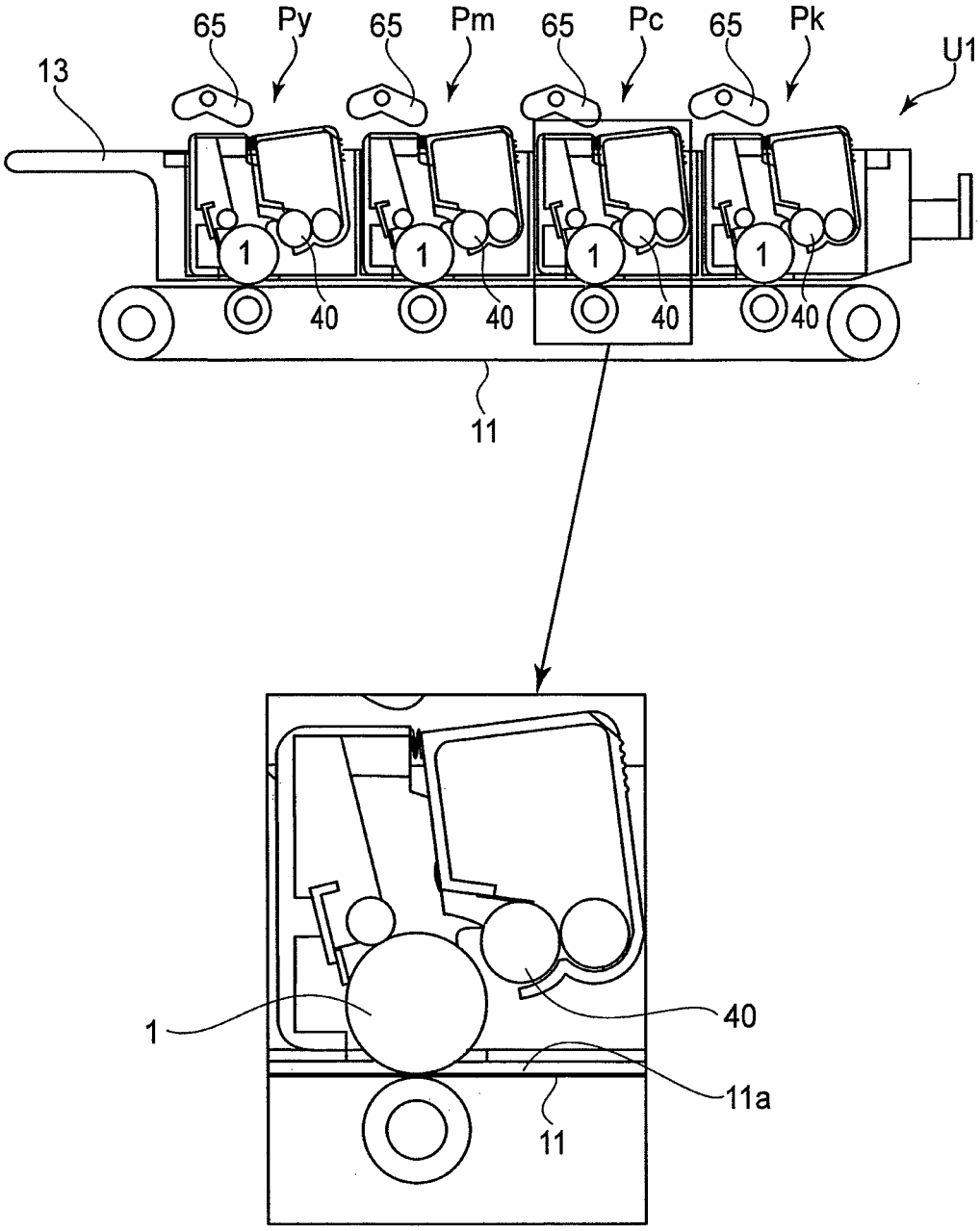
FIG. 17 is a schematic sectional view illustrating the state in the course of the drawer unit according to Embodiment 1 of the present invention being mounted in the main assembly and shifting to an image forming operation.
Figure 18:
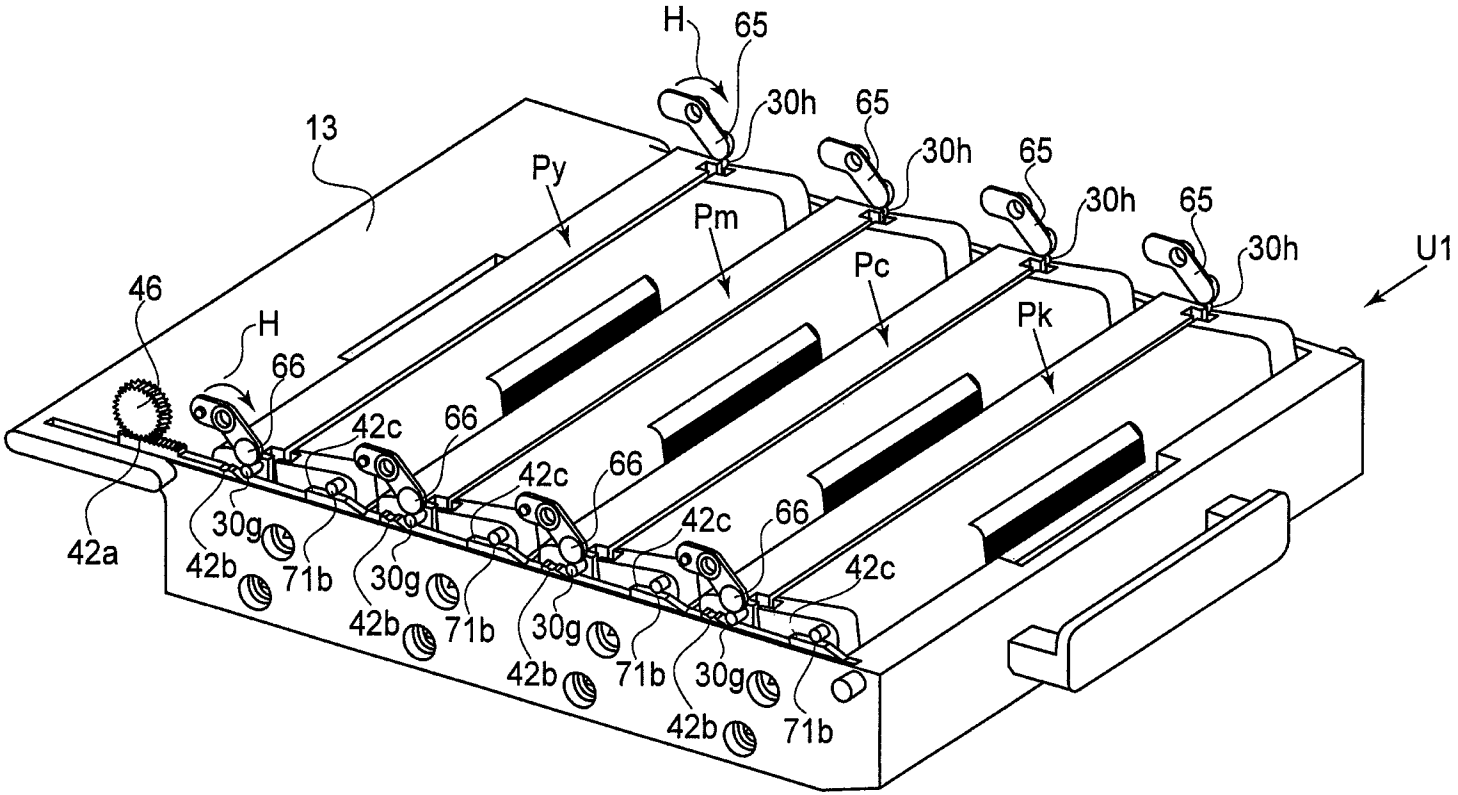
FIG. 18 is a perspective view illustrating the state in the partway of shifting to the image forming operation in the drawer unit according to Embodiment 1 of the present invention.
Figure 19:
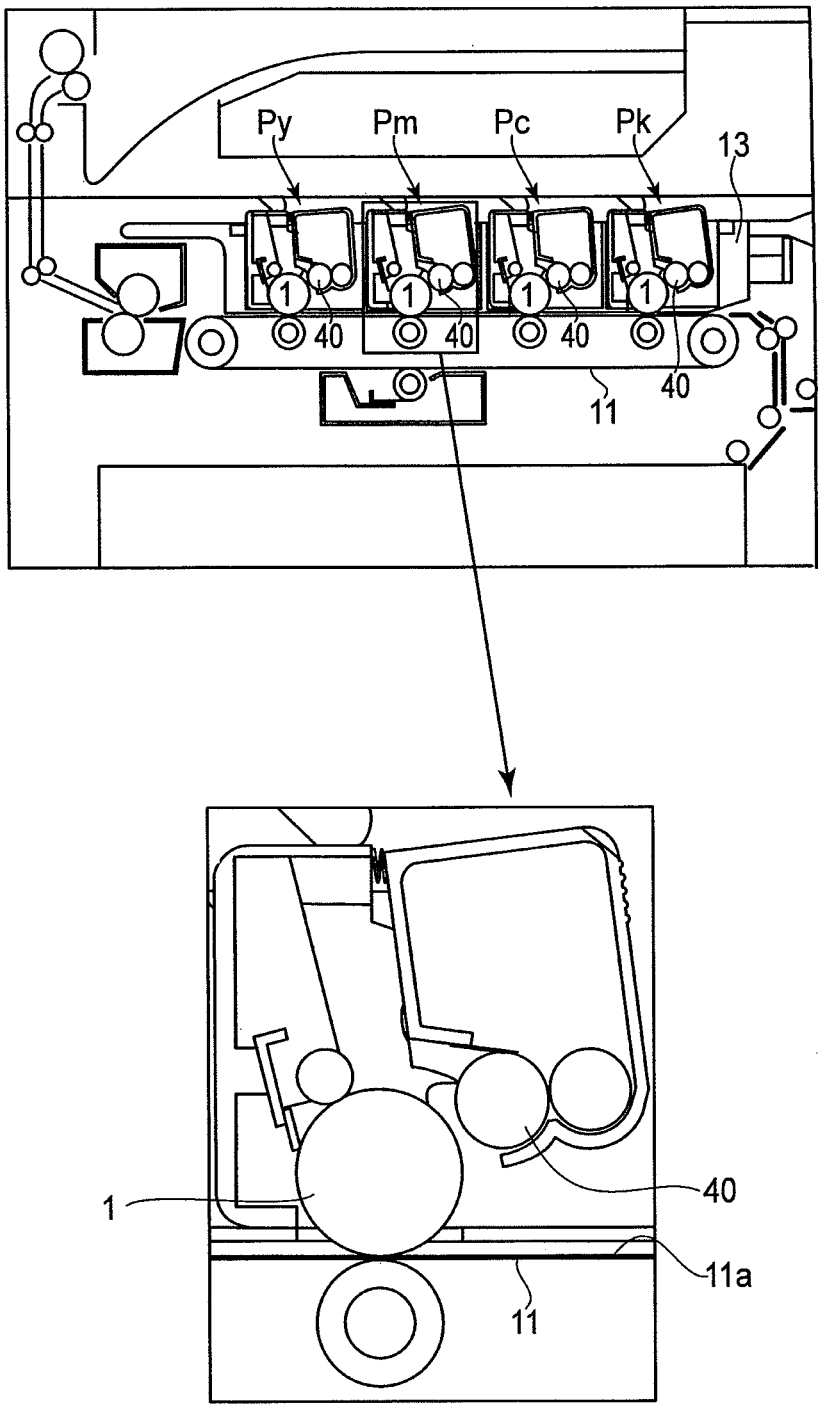
FIG. 19 is a schematic sectional view illustrating the state in the partway of shifting to the image forming operation in the image forming apparatus according to Embodiment 1 of the present invention.
Figure 20:
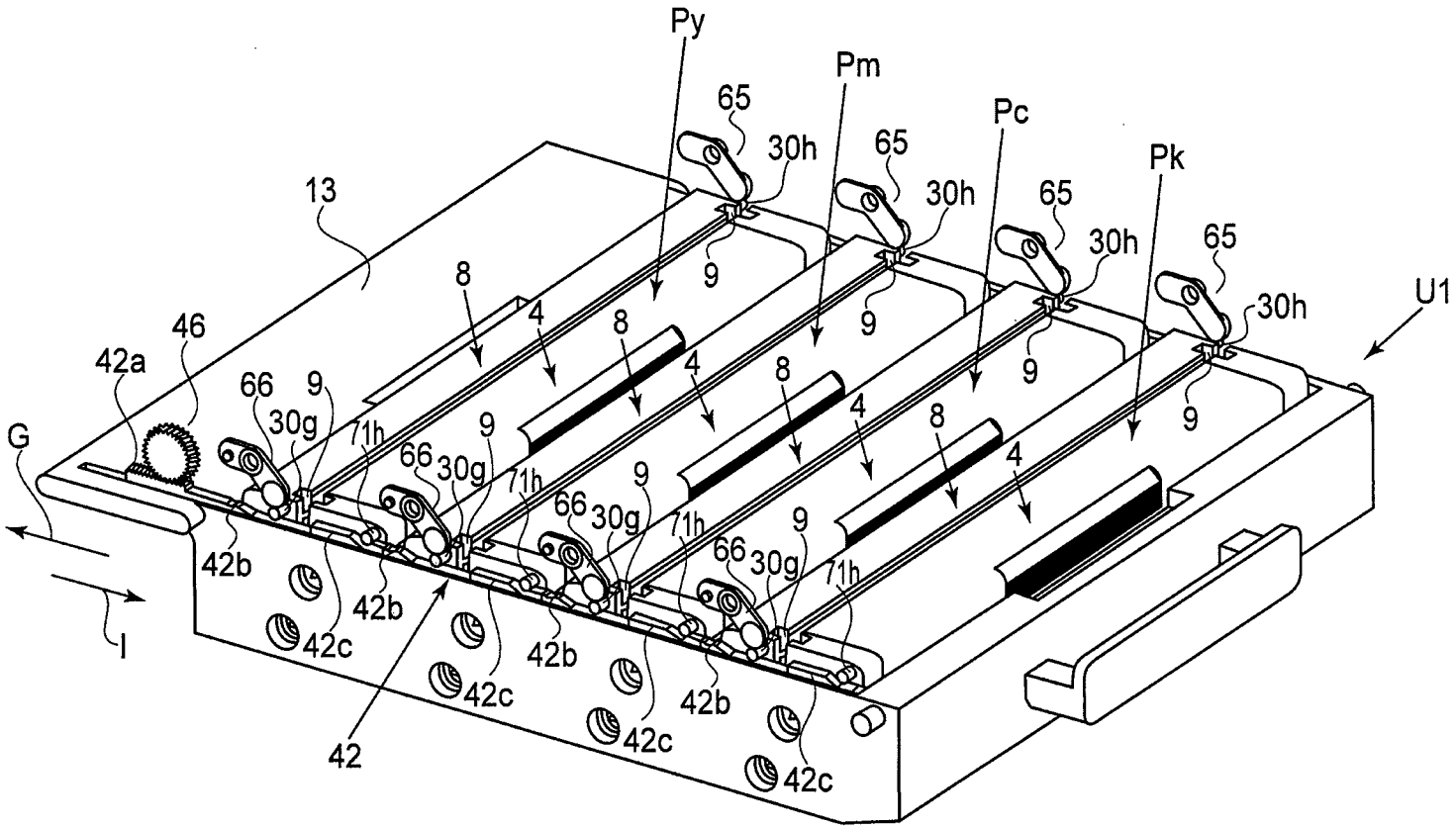
FIG. 20 is a perspective view illustrating the state of the partway shifting to the image forming operation in the drawer unit according to Embodiment 1 of the present invention.
Figure 21:
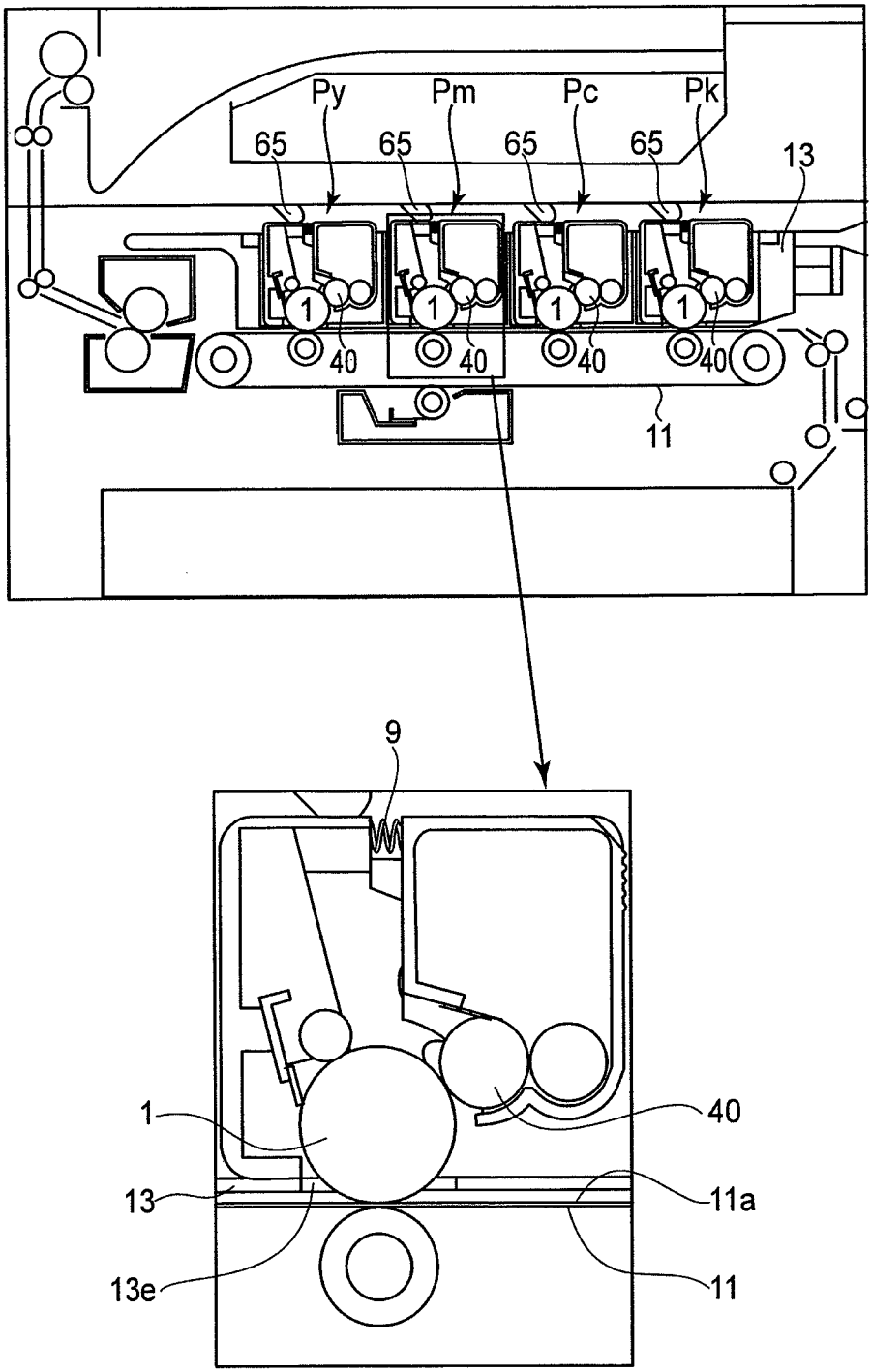
FIG. 21 is a schematic sectional view illustrating the state that the image forming operation in the image forming apparatus according to Embodiment 1 of the present invention is enabled.
Figure 22:
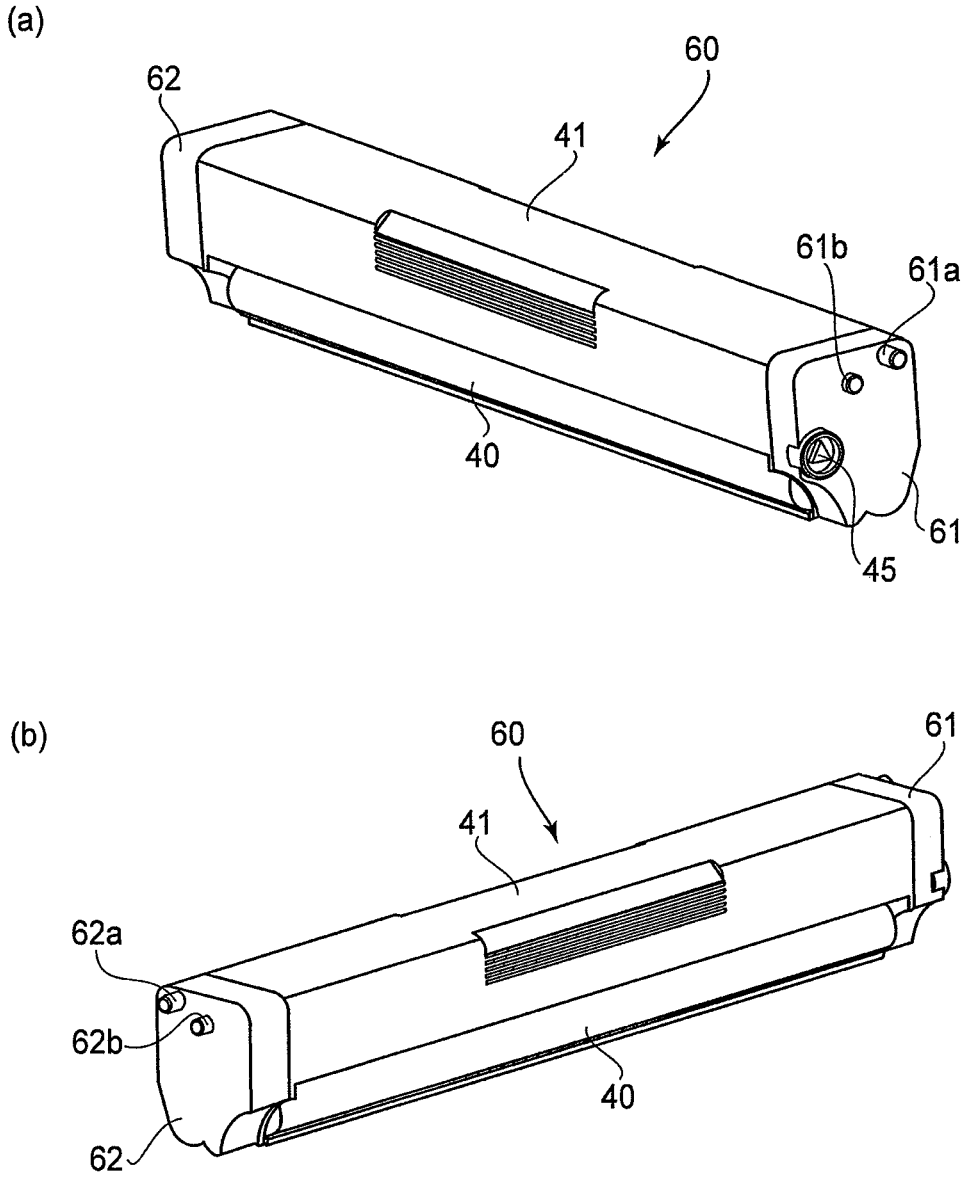
FIG. 22 is a perspective view of a developing cartridge according to Embodiment 2 of the present invention.
Figure 23:
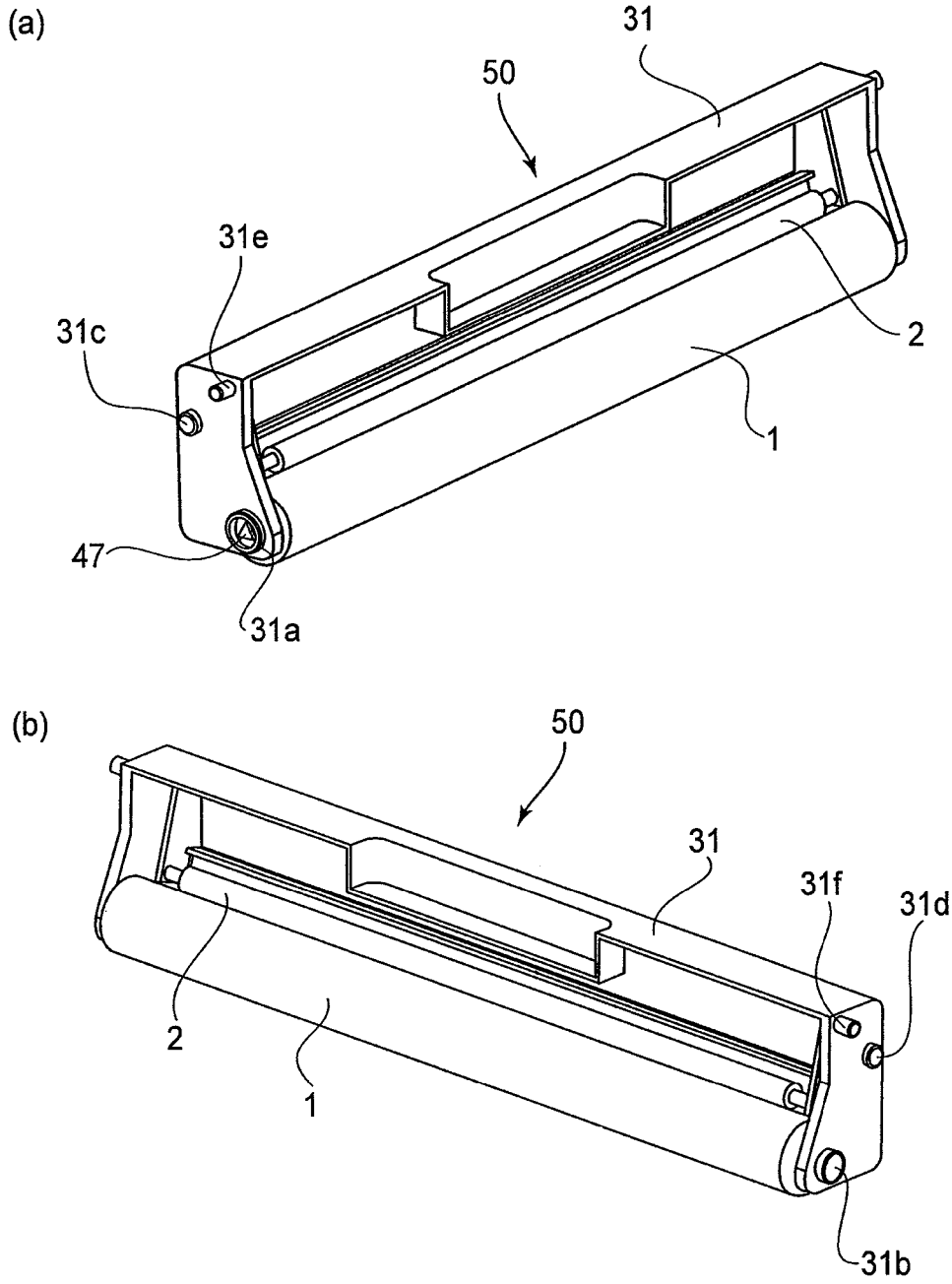
FIG. 23 is a perspective view of a photosensitive member cartridge according to Embodiment 2 of the present invention.
Figure 24:
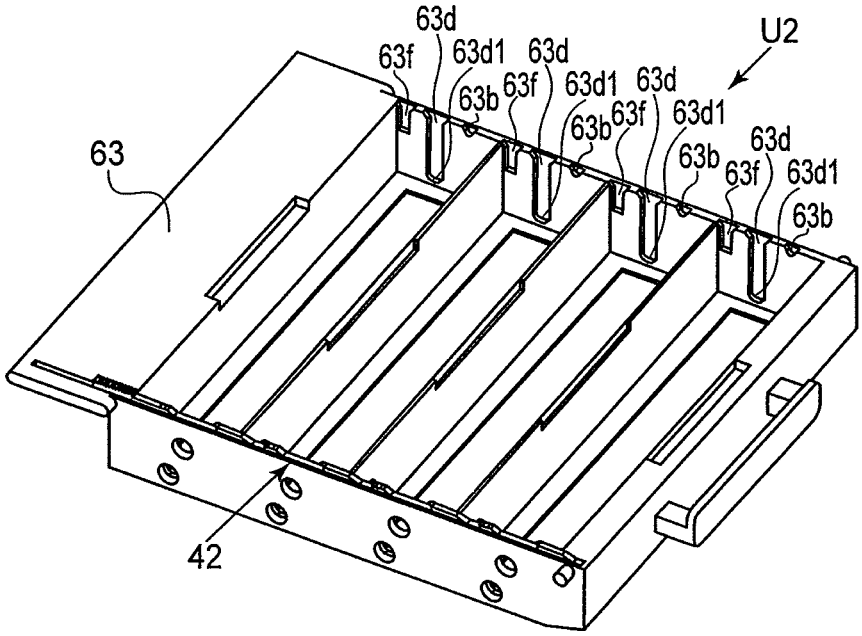
FIG. 24 is a perspective view of the drawer unit in the image forming apparatus according to Embodiment 2 of the present invention.
Figure 25:
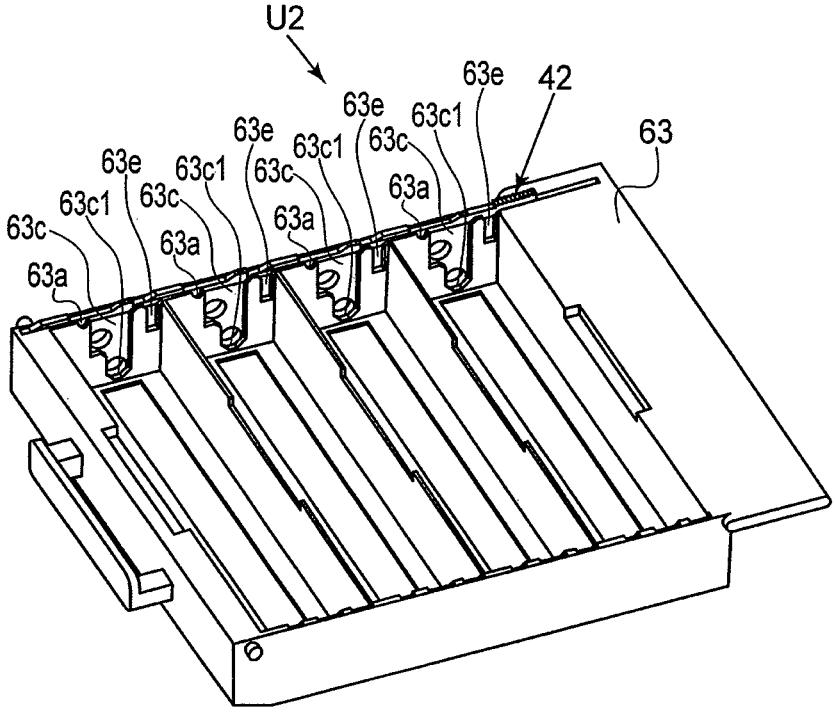
FIG. 25 is a perspective view of the drawer unit in the image forming apparatus according to Embodiment 2 of the present invention.
Figure 26:
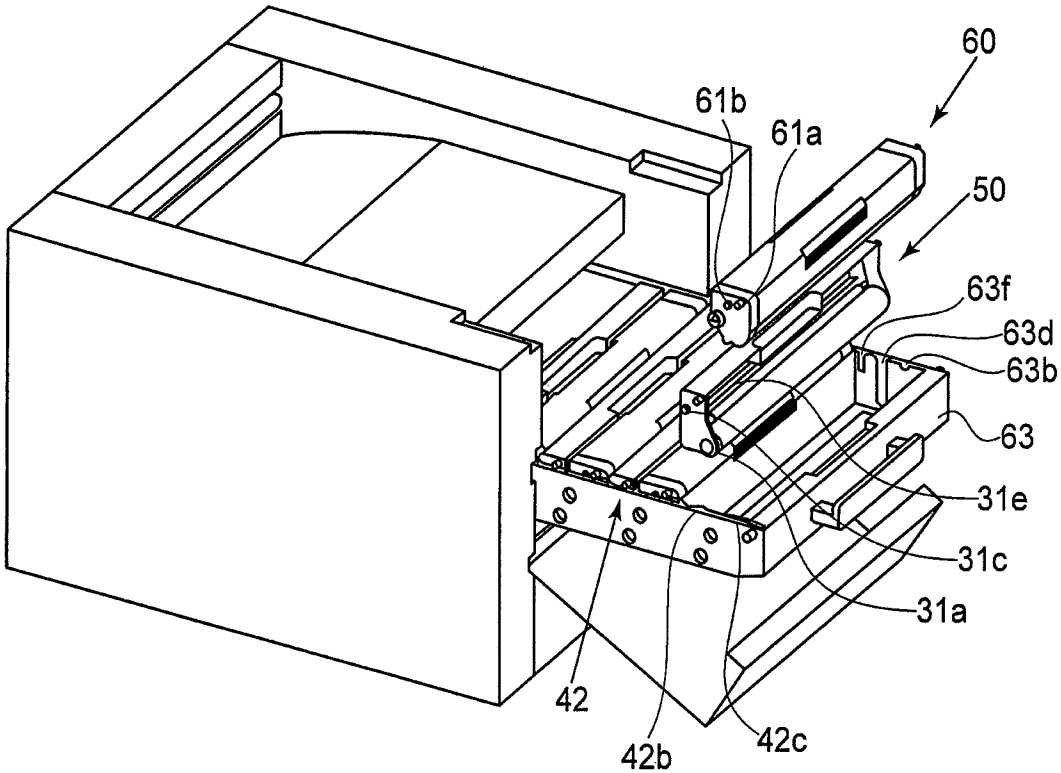
FIG. 26 is a perspective view illustrating the state that the photosensitive member cartridge and the developing cartridge according to Embodiment 2 of the present invention is mounted to the drawer member.
Figure 27:
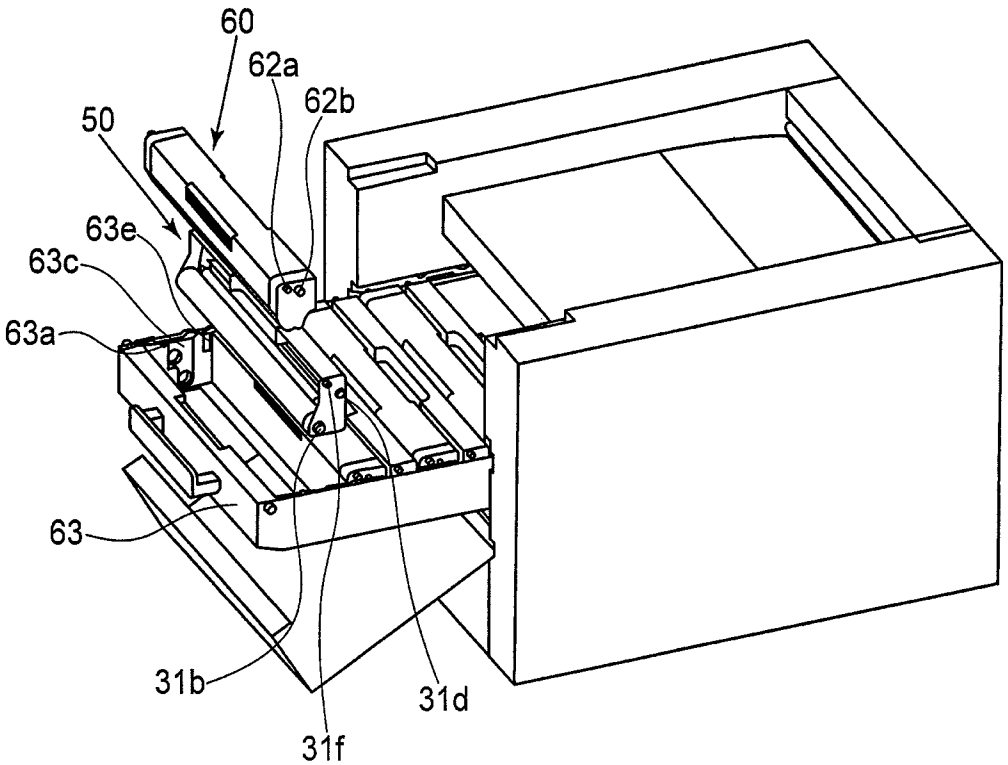
FIG. 27 is a perspective view illustrating the state that the photosensitive member cartridge and the developing cartridge according to Embodiment 2 of the present invention is mounted to the drawer member.
Figure 28:
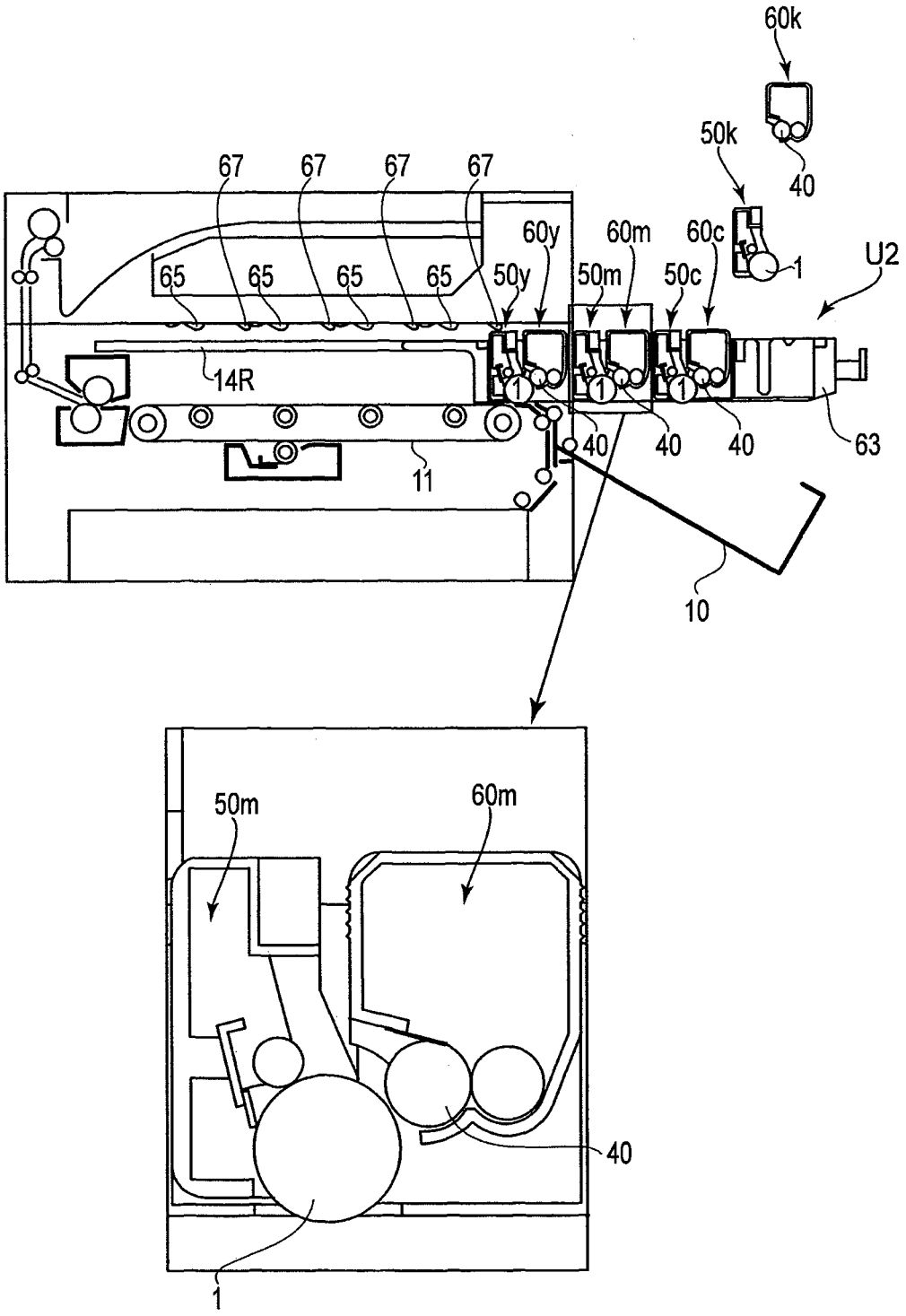
FIG. 28 is a schematic sectional view illustrating the state that the drawer unit according to Embodiment 2 of the present invention is mounted in the main assembly.
Figure 29:
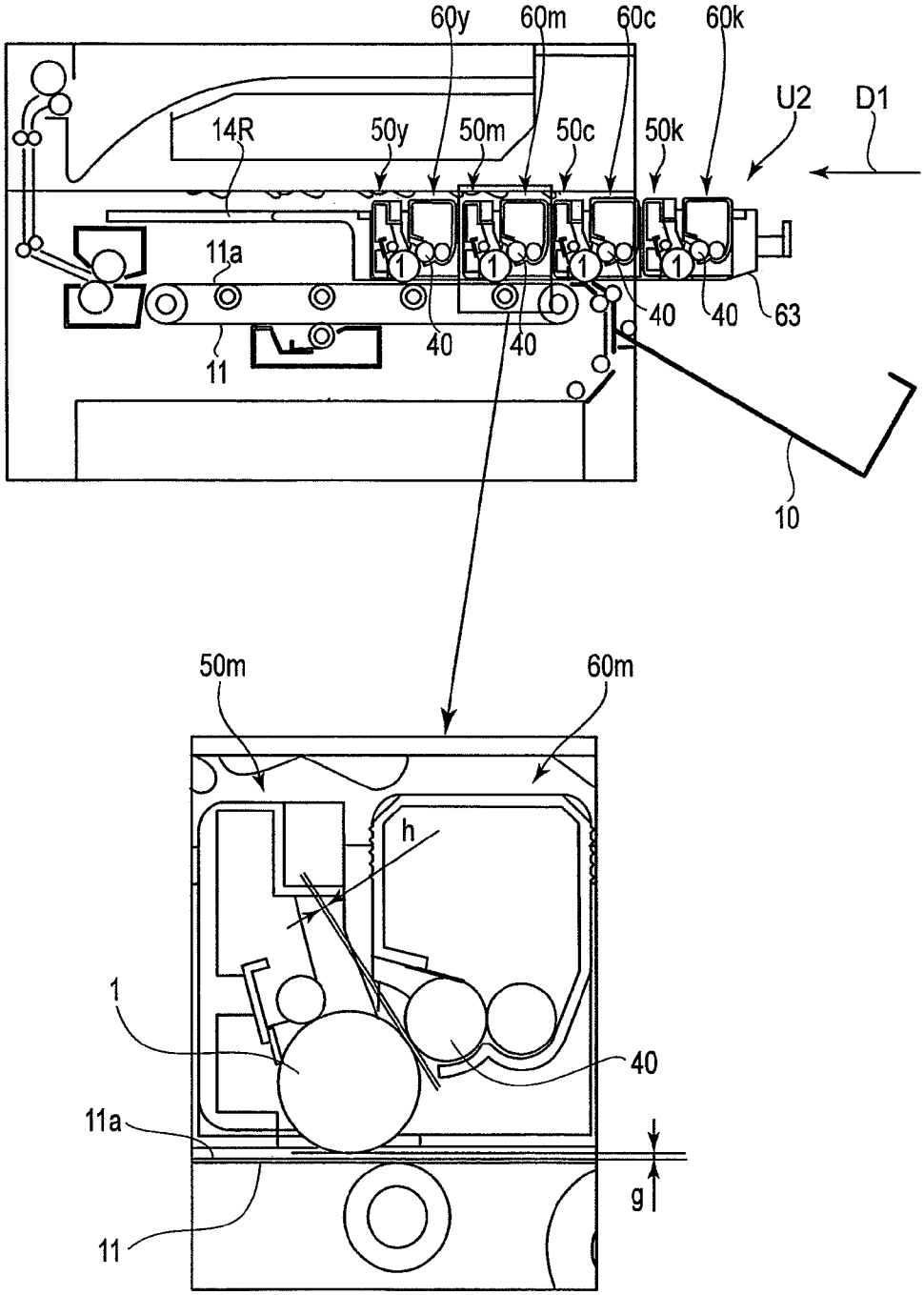
FIG. 29 is a schematic sectional view illustrating the state that the drawer unit according to Embodiment 2 of the present invention is mounted in the main assembly.
Figure 30:
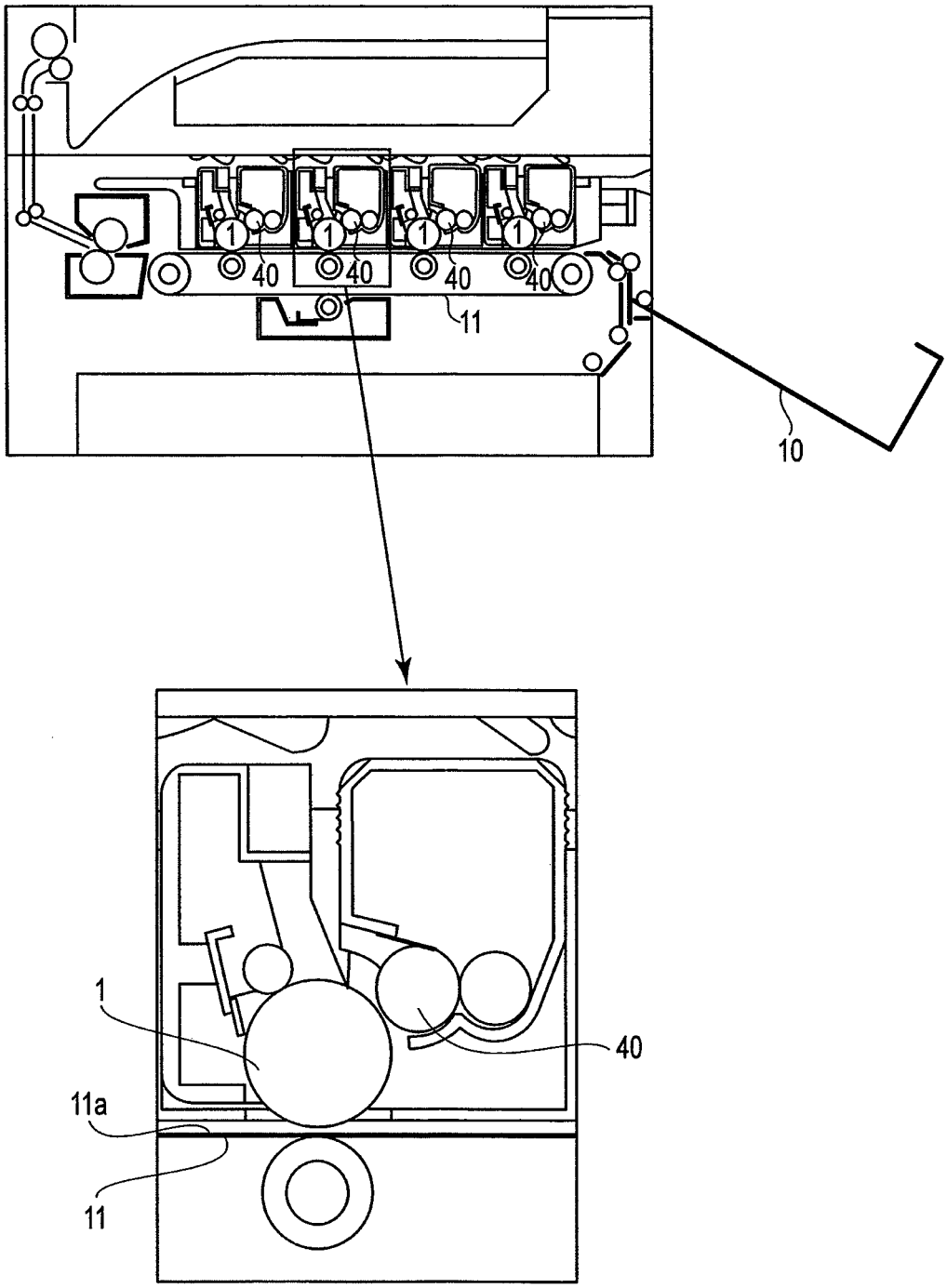
FIG. 30 is a schematic sectional view illustrating the state of the state that o mounting of the drawer unit according to Embodiment 2 of the present invention is done in the main assembly, and the door is open.
Figure 31:
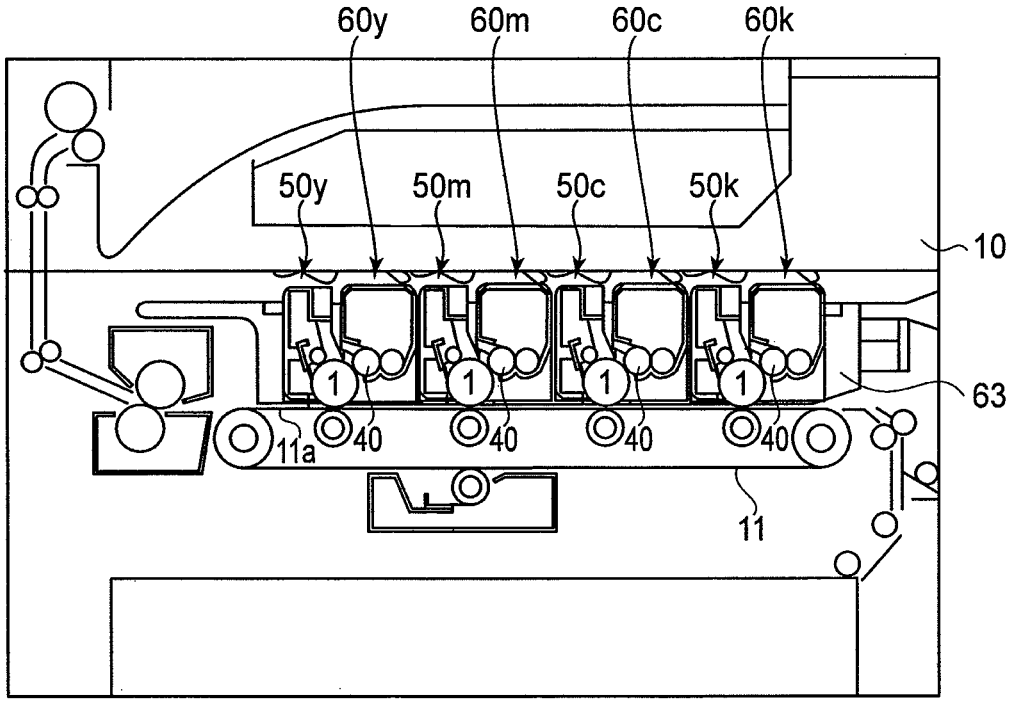
FIG. 31 is a schematic sectional view illustrating the state that the drawer unit according to Embodiment 2 of the present invention is mounted in the main assembly and the door closes.
Figure 34:
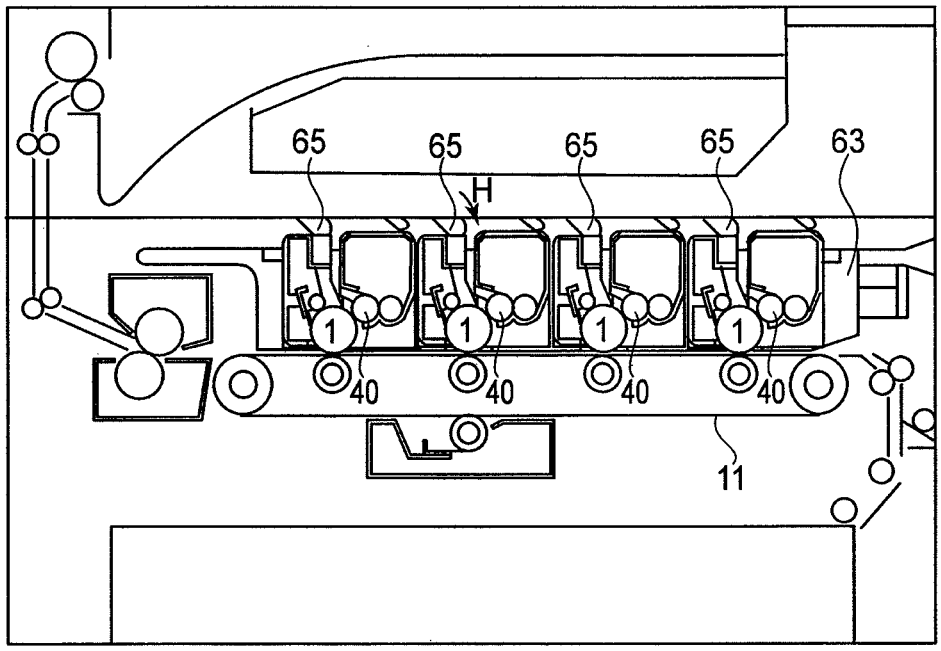
FIG. 34 is a schematic sectional view illustrating the state in the course of the shifting to the image forming operation in the image forming apparatus according to Embodiment 2 of the present invention.
Figure 32:
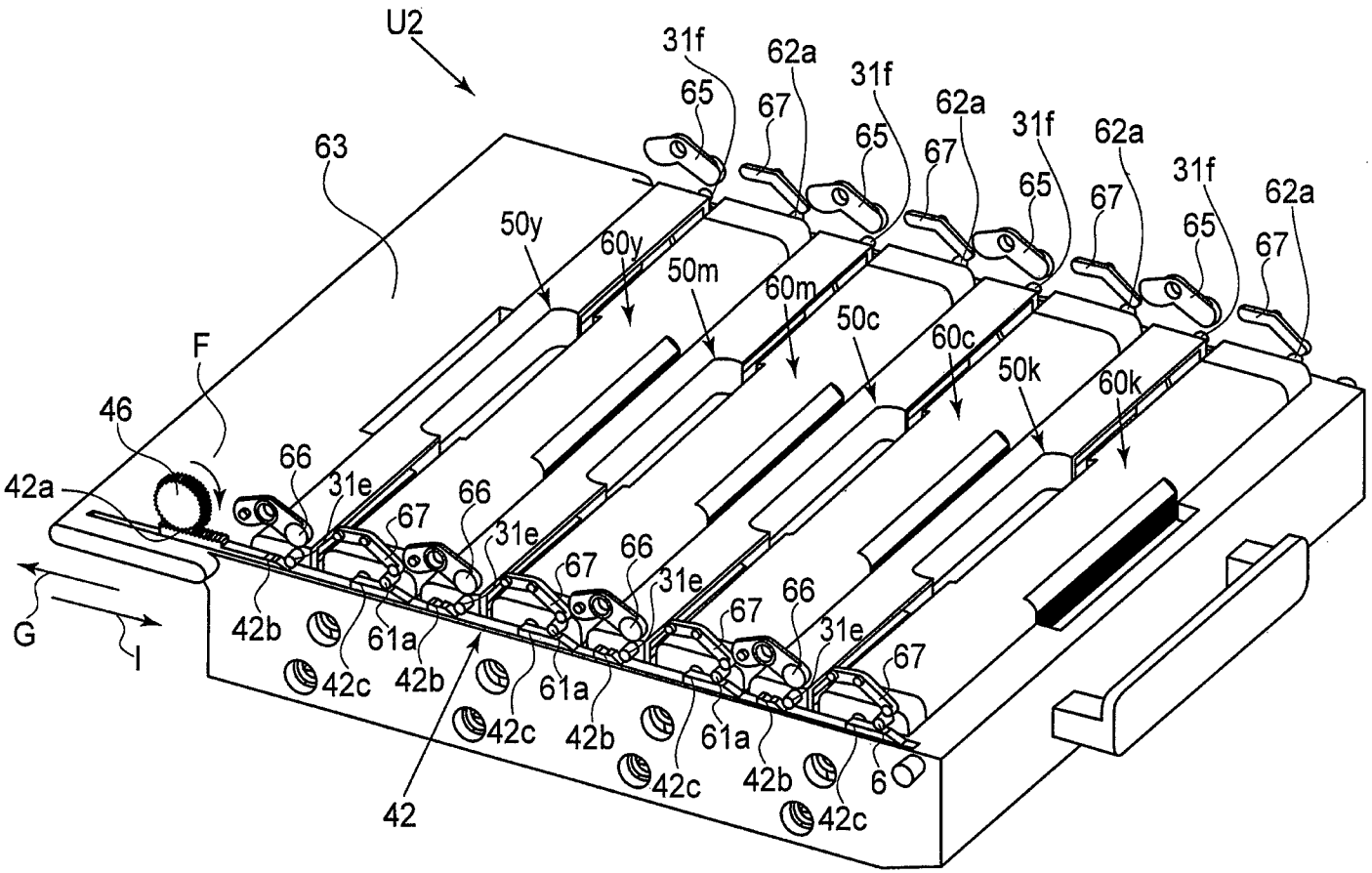
FIG. 32 is a perspective view illustrating the state immediately after the image formation instruction in the drawer unit according to Embodiment 2 of the present invention.
Figure 33:
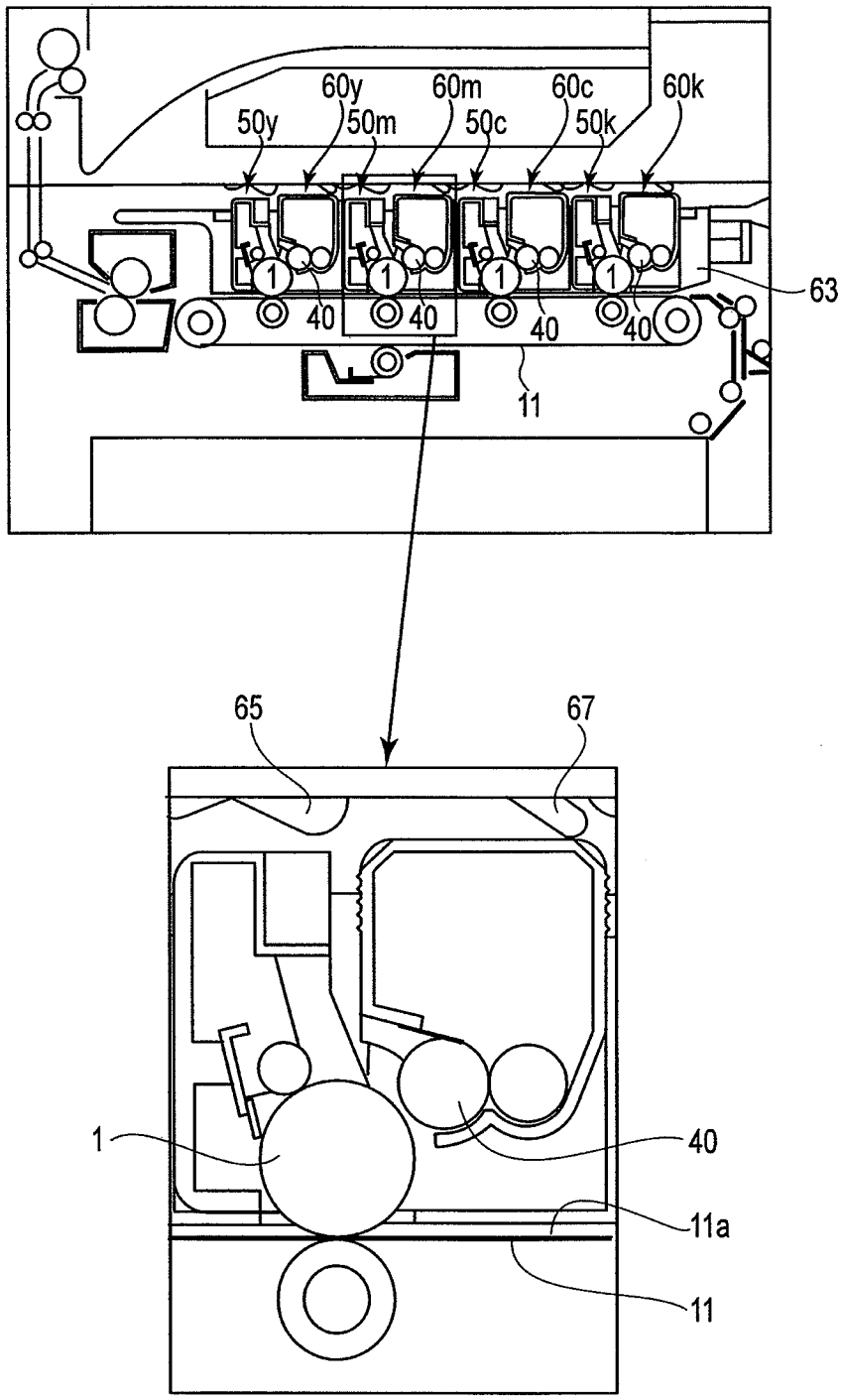
FIG. 33 is a schematic sectional view illustrating the drawer unit according to Embodiment 2 of the present invention, which is mounted in the main assembly and, and which is in the partway of shifting to the image forming operation.
Figure 35:
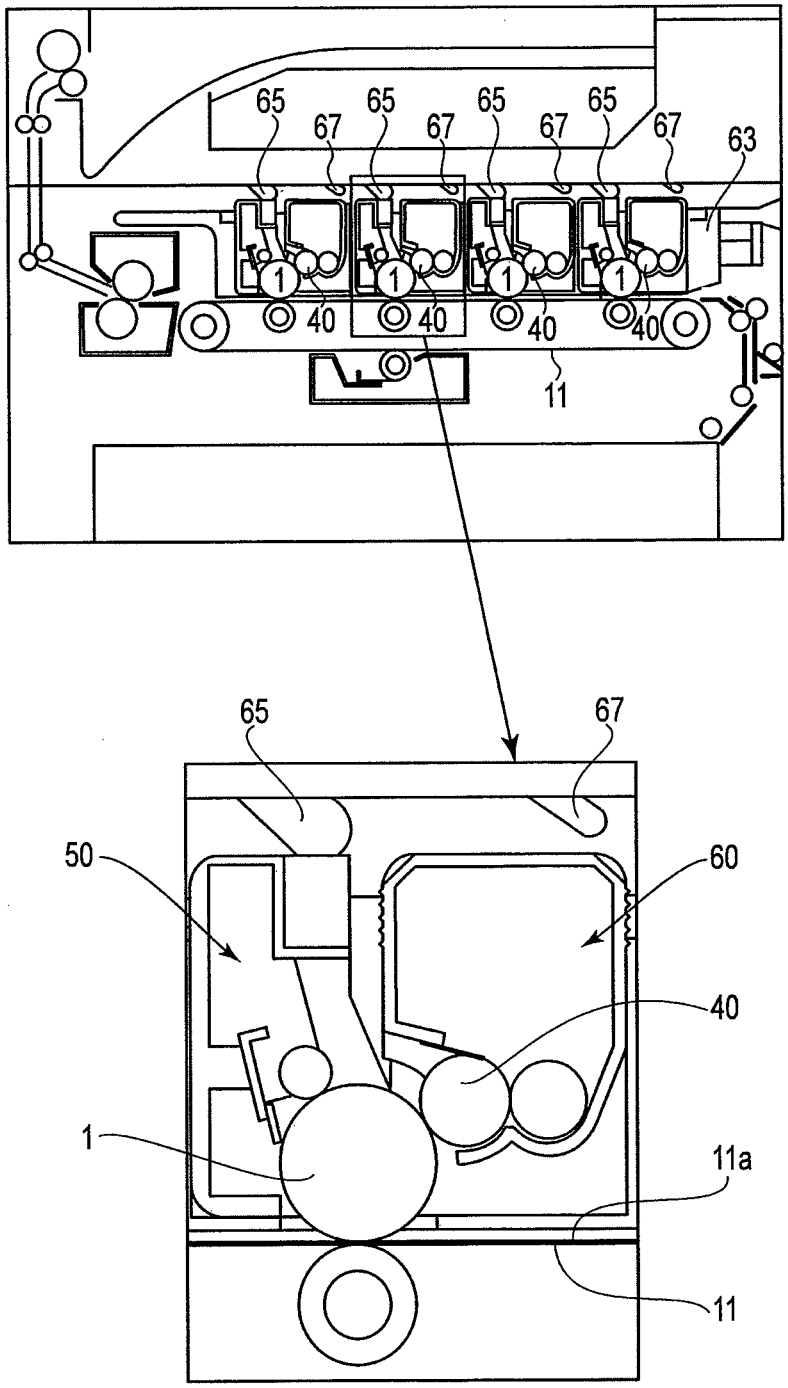
FIG. 35 is a schematic sectional view illustrating the state in the course of the shifting to the image forming operation in the image forming apparatus according to Embodiment 2 of the present invention.
Figure 36:
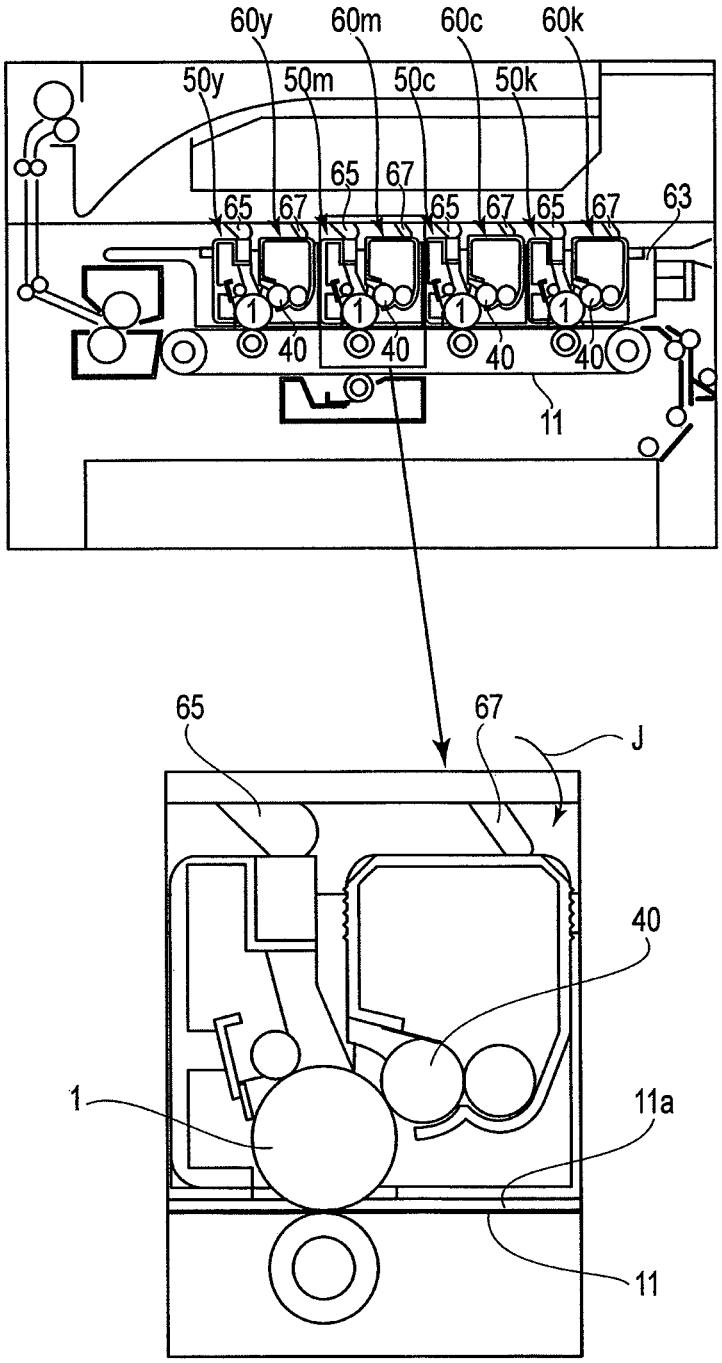
FIG. 36 is a schematic sectional view illustrating the state that the image forming operation in the image forming apparatus according to Embodiment 2 of the present invention is enabled.
Figure 37:
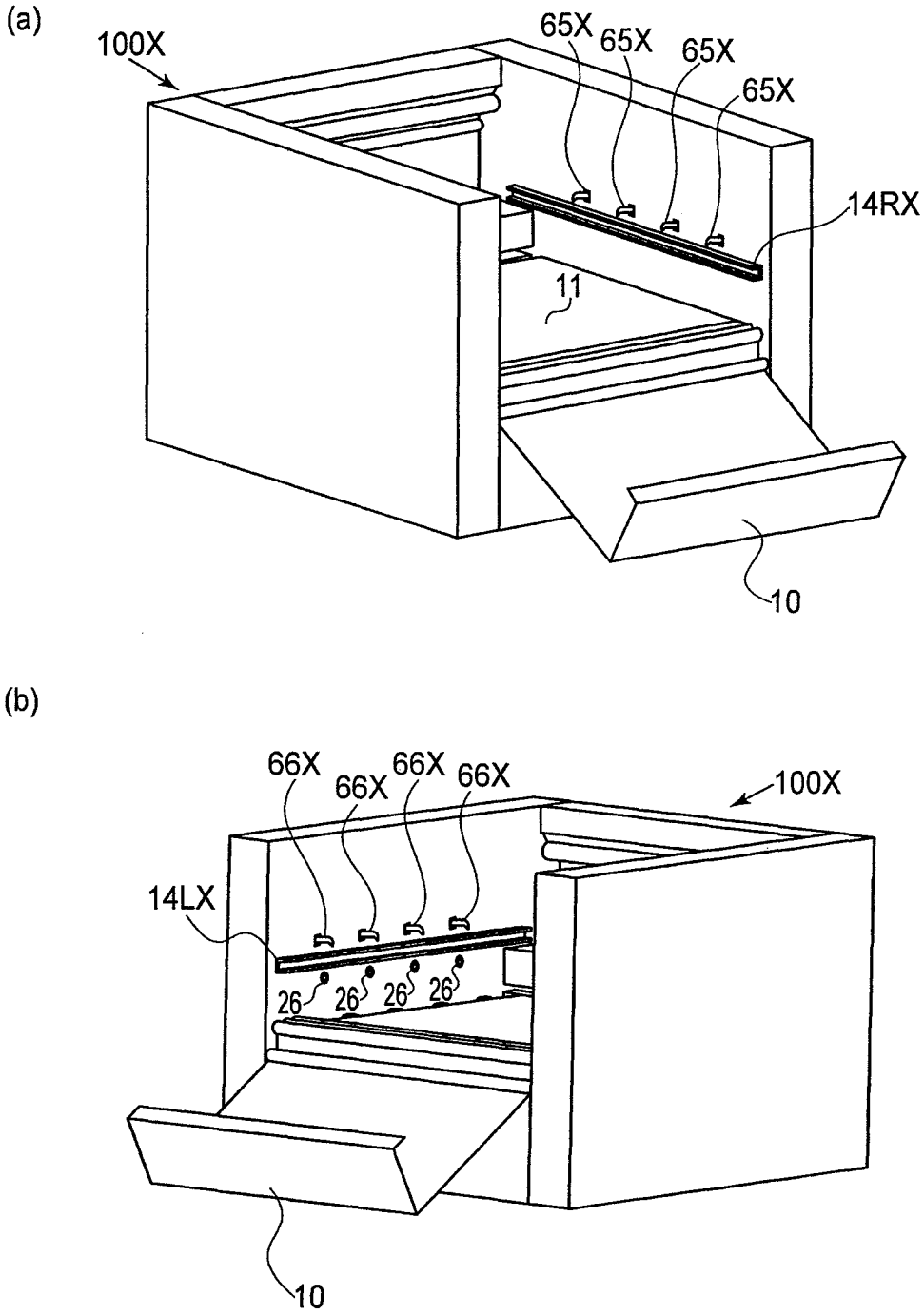
FIG. 37 is a perspective view illustrating a mounting portion of the drawing unit in the main assembly of the apparatus of the image forming apparatus according to embodiment 3 of the present invention.
Figure 38:
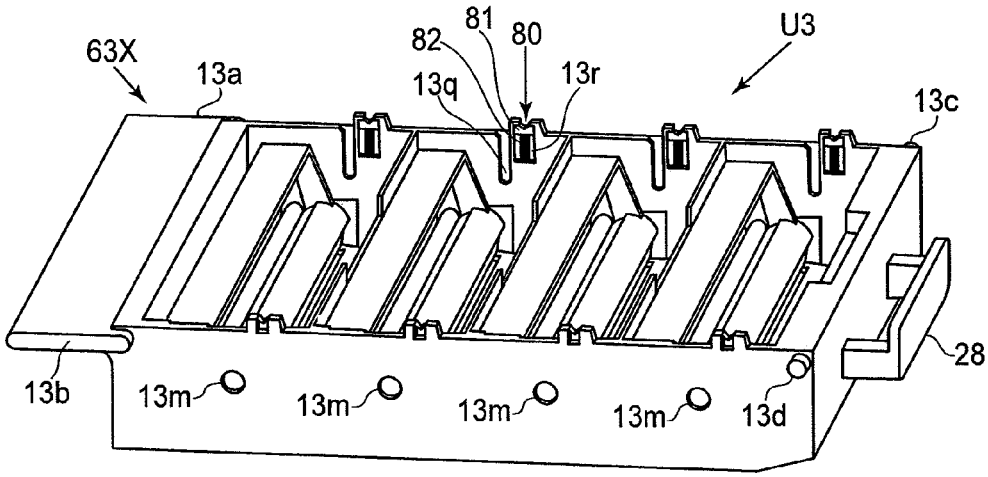
FIG. 38 is a perspective view of the drawing unit for the image forming apparatus of embodiment 3 of the present invention.
Figure 39:
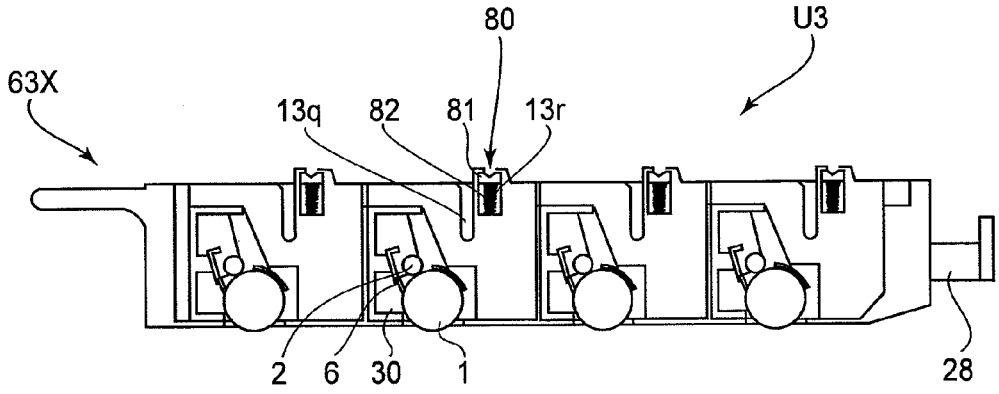
FIG. 39 is a schematic sectional view of the drawing unit for the image forming apparatus of embodiment 3 of the present invention.
Figure 40:
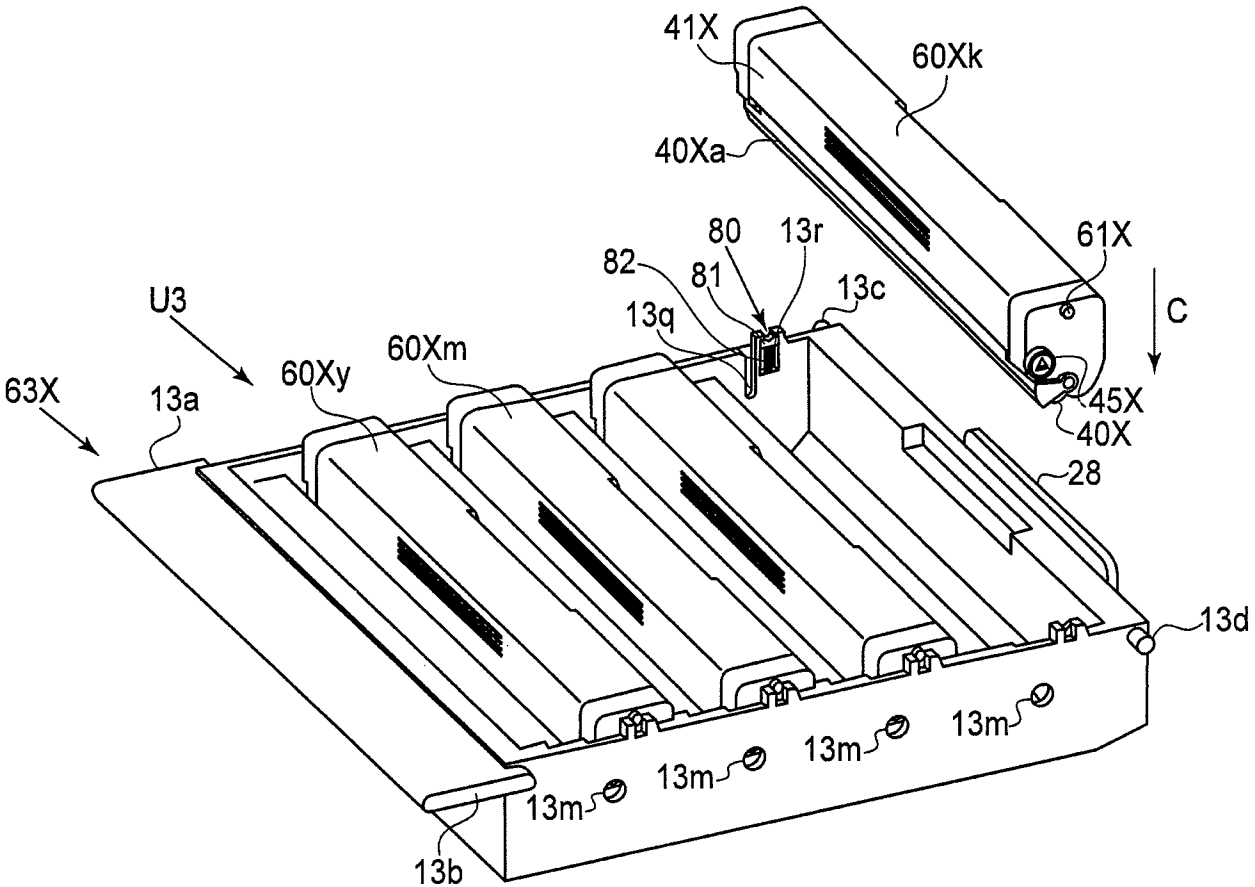
FIG. 40 is a perspective view illustrating behavior in the mounting of the developing cartridge to the drawer member in the image forming apparatus of embodiment 3 of the present invention.
Figure 41:
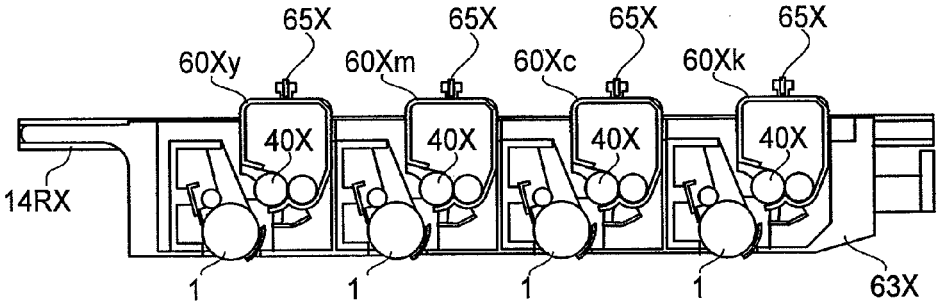
FIG. 41 is a schematic sectional view illustrating a state in which the developing cartridge is mounted, and the image forming operation is not carried out in the image forming apparatus of embodiment 3 according to the present invention.
Figure 42:
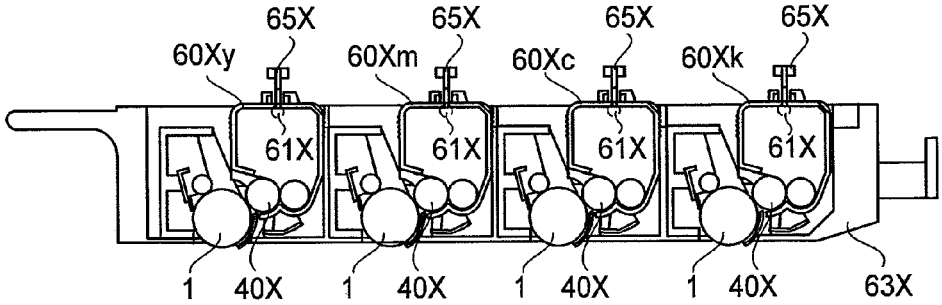
FIG. 42 is a schematic sectional view illustrating a state in which the positioning of the developing cartridge is completed (state capable of image formation) in the image forming apparatus of embodiment 3 according to the present invention.

According to the present invention, there is provided a downsized electrophotographic image forming apparatus with which a drawer member mounting a photosensitive drum and a developing unit is mounted into a main assembly of the apparatus, and the developing roller and the photosensitive drum can be contacted and spaced relative to each other is provided.

The invention claimed is:

1. An electrophotographic image forming apparatus comprising:

a process cartridge including (i) an electrophotographic photosensitive member, (ii) a developing roller for developing an electrostatic latent image formed on said electrophotographic photosensitive member, and (iii) a developer accommodating portion for accommodating a developer to be supplied to said developing roller;

a main assembly; and a supporting member movable between an inside position which is inside said main assembly of the apparatus and in which said supporting member demountably supports said process cartridge and an outside position outside said main assembly, wherein said supporting member includes a contacting and spacing member capable of taking a contacting position for contacting said developing roller to said electrophotographic photosensitive member and a spacing position for spacing said developing roller from said electrophotographic photosensitive member, wherein said contacting and spacing member includes a driving force receiving portion for receiving a driving force for moving between the contacting position and the spacing position, and wherein, when said supporting member is in the outside position, said contacting and spacing member is in the spacing position.

2. An apparatus according to claim 1, wherein said process cartridge includes an urging member for urging said developing roller toward said electrophotographic photosensitive member to contact said developing roller to said electrophotographic photosensitive member, and wherein, when said supporting member is in the inside position, said urging member urges said developing roller to contact said developing roller to said electrophotographic photosensitive member by said contacting and spacing member moving from the spacing position to the contacting position.

3. An apparatus according to claim 1, wherein said process cartridge includes a photosensitive member unit containing said electrophotographic photosensitive member, and includes a developing unit containing said developing roller, said developing unit being movable relative to said photosensitive member unit, and wherein said contacting and spacing member acts on said developing unit.

4. An apparatus according to claim 1, wherein said contacting and spacing member acts on said process cartridge.

5. An electrophotographic image forming apparatus comprising:

a developing cartridge including (i) a developing roller for developing an electrostatic latent image formed on an electrophotographic photosensitive member while contacting the electrophotographic photosensitive member, and (ii) a developer accommodating portion for accommodating a developer to be supplied to said developing roller;

a main assembly; and a supporting member movable between an inside position which is inside said main assembly of the apparatus and in which said supporting member demountably supports said developing cartridge and an outside position outside said main assembly, wherein said supporting member includes a contacting and spacing member capable of taking a contacting position for contacting said developing roller to said electrophotographic photosensitive member and a spacing position for spacing said developing roller from said electrophotographic photosensitive member, wherein said contacting and spacing member includes a driving force receiving portion for receiving a driving force for moving between the contacting position and the spacing position, and wherein when said supporting member is in the outside position, said contacting and spacing member is in the spacing position.

6. An apparatus according to claim 5, wherein said main assembly includes an urging member for urging said developing cartridge to contact said developing roller to said electrophotographic photosensitive member, and wherein, when said supporting member is in the inside position, said urging member urges said developing cartridge to move said contacting and spacing member from the spacing position to the contacting position so that said developing roller and said electrophotographic photosensitive member contact to each other.

* * * * *